US005359862A

United States Patent [19]

Nagashima et al.

[11] Patent Number: 5,359,862

[45] Date of Patent: Nov. 1, 1994

[54] METHOD AND APPARATUS FOR DETECTING AN AMOUNT OF COOLING MEDIUM CHARGED IN A REFRIGERATION CIRCULATION SYSTEM

[75] Inventors: Hisao Nagashima; Hideaki Sato, both of Anjo; Shin Honda, Nagoya; Keiichi Kitamura, Handa, all of Japan

[73] Assignee: Nippondenso Co., Ltd., Kariya, Japan

[21] Appl. No.: 133,384

[22] Filed: Oct. 8, 1993

[30] Foreign Application Priority Data

Oct. 9, 1992 [JP] Japan ..... 4-271838

[51] Int. Cl.[5] ..... F25B 49/02

[52] U.S. Cl. ..... 62/129; 62/125; 62/511; 116/276

[58] Field of Search ..... 62/129, 125, 126, 127, 62/149, 511, 197, 292; 116/276; 137/559

[56] References Cited

U.S. PATENT DOCUMENTS

| | | | |
|---|---|---|---|
| 3,525,231 | 8/1970 | Armstrong | 62/125 |
| 3,752,185 | 8/1973 | Mullins | 116/276 X |
| 3,753,356 | 8/1973 | Kramer | 62/125 X |
| 4,064,826 | 12/1977 | Pauli | 116/276 |
| 4,644,755 | 2/1987 | Esslinger et al. | 62/129 |
| 4,649,711 | 3/1987 | Sibley et al. | 62/129 |

*Primary Examiner*—Harry B. Tanner
*Attorney, Agent, or Firm*—Cushman, Darby & Cushman

[57] ABSTRACT

A cooling medium charge amount detector capable of detecting whether or not an actual amount of a cooling medium is a desired amount in comparison with the amount of the cooling medium necessary for a desired degree of supercooling on an inlet side of an expansion valve in a refrigeration circulation system, without using a sensor or computation means. A cooling medium on the inlet side of an expansion valve 23 in a refrigeration circulation system 20 is allowed to flow into a cooling medium charge amount detector 40. Throttles 41, 42, 43 are disposed in this cooling medium charge amount detector 40, and sight glasses 44, 45, 46 are disposed at both ends of the throttles 41, 42, 43 to detect a gas-liquid condition of the cooling medium. When the cooling medium flows into this cooling medium charge amount detector, the shift of the cooling medium from a liquid condition to a two-phase gas-liquid condition is checked upstream or downstream of any throttle to match the load condition at that time. In this way, a pressure difference proportional to the degree of supercooling can be detected and eventually, whether or not the charge amount of the cooling medium is suitable in the refrigeration circulation system 20 can be detected.

12 Claims, 20 Drawing Sheets

: GASEOUS PHASE CONDITION

: GAS-LIQUID TWO-PHASE CONDITION

: LIQUID PHASE CONDITION

METHOD AND APPARATUS FOR DETECTING AN AMOUNT OF COOLING MEDIUM CHARGED IN A REFRIGERATION CIRCULATION SYSTEM

BACKGROUND OF THE INVENTION

1. Field of the Invention

This invention relates to a method and apparatus for detecting an amount of a cooling medium charged in a refrigeration circulation system used for a refrigerator or an air conditioner.

2. Description of the Related Art

In a refrigeration circulation system 20 including a compressor 21 for compressing a gaseous cooling medium, a condenser 22 for cooling the gaseous cooling medium compressed by the compressor 21 and converting it to a liquid cooling medium, an expansion valve 23 for expanding the cooling medium converted to the liquid cooling medium by the condenser 22 and converting it to an atomized cooling medium, and an evaporator 24 for subjecting the cooling medium atomized by the expansion valve 23 to heat-exchange with air as shown in FIGS. 4 and 5 of the accompanying drawings, it is known that when the liquid cooling medium on the inlet side of the expansion valve 23 is appropriately super-cooled, a coefficient of performance of the refrigeration circulation system 20 can be improved.

To super-cool the liquid cooling medium on the inlet side of the expansion valve 23, the cooling medium must be suitably charged into the refrigeration circulation system 20.

However, if an excess amount of cooling medium is charged, the liquid cooling medium at the inlet of the expansion valve 23 will have an excess degree of super-cooling, and the coefficient of performance will be deteriorated. Accordingly, it is necessary to detect whether or not a suitable degree of super-cooling is attained when the cooling medium is first charged into the refrigeration circulation system or when it is added.

As disclosed in Japanese Unexamined Patent Publication (Kokai) No. 3-177762, for example, a detector for detecting the degree of super-cooling uses a pressure sensor, a temperature sensor and a computation means. This detector detects the pressure of the cooling medium downstream of the compressor by the use of the pressure sensor and calculates a temperature T1 of supercooling to 0° C. after the condenser at this detected pressure. An actual temperature T2, after the condenser, is detected by the temperature sensor, and the difference between the temperatures T2 and T1 is calculated so as to detect the degree of super-cooling.

However, the detector for detecting the degree of super-cooling according to the prior art described above involves a problem in that it is expensive because it requires the temperature sensor, the pressure sensor and the computation means.

SUMMARY OF THE INVENTION

It is therefore an object of the present invention to provide a method and apparatus for detecting a charged amount of a cooling medium, capable of detecting whether or not an actual amount of the cooling medium is a desired amount, in comparison with a desired amount of the cooling medium necessary for having a desired super-cooling amount on the inlet side of an expansion valve in a refrigeration circulation system, without using sensors and computation means.

In a refrigeration circulation system which includes a compressor for compressing a gaseous cooling medium, a condenser for cooling the gaseous cooling medium compressed by the compressor and converting it to a liquid cooling medium, first pressure reduction means for reducing the pressure of the cooling medium converted to the liquid cooling medium by the condenser and converting it to an atomized cooling medium, and an evaporator for subjecting the cooling medium atomized by the first pressure reduction means to heat-exchange with air, and in which the cooling medium on the inlet side of the first pressure reduction means has a certain degree of super-cooling, the object of the present invention as described above can be accomplished by a method of detecting a cooling medium charge amount to determine whether or not an actual amount of a cooling medium is a desired amount, in comparison with an amount of the cooling medium necessary to achieve a desired degree of super-cooling. The method comprises disposing second pressure reduction means in parallel with the first pressure reduction means, for reducing the pressure of the cooling medium flowing from the condenser to an evaporation pressure at the evaporator over a plurality of stages through at least a desired intermediate pressure; detecting whether the cooling medium immediately after the pressure reduction to the desired intermediate pressure is in a gas-liquid two-phase condition or a liquid phase condition; judging, when the desired intermediate pressure is lower than a pressure on a saturation liquid line when the desired amount of the cooling medium is sealed into the refrigeration circulation system, that the desired amount of the cooling medium is charged when the cooling medium is in the gas-liquid two-phase condition, and excess cooling medium is charged when the cooling medium is in the liquid phase condition at this intermediate pressure; and further judging, when the desired intermediate pressure is higher than the pressure on the saturation liquid line when the desired amount of the cooling medium is charged into the refrigeration circulation system, the desired amount of the cooling medium is charged when the cooling medium is in the liquid phase condition at this intermediate pressure, and the cooling medium is insufficient when the cooling medium is in the gas-liquid two-phase condition at this intermediate pressure.

In a refrigeration circulation system which includes a compressor for compressing a gaseous cooling medium, a condenser for cooling the gaseous cooling medium compressed by the compressor and converting it to a liquid cooling medium, pressure reduction means for reducing the pressure of the cooling medium converted to the liquid cooling medium by the condenser and converting it to an atomized cooling medium, and an evaporator for subjecting the cooling medium atomized by the pressure reduction means to heat-exchange with air, and in which the cooling medium on the inlet side of the pressure reduction means has a certain degree of super-cooling, a method for detecting whether or not an actual amount of a cooling medium is a desired amount in comparison with an amount of the cooling medium necessary for having a desired degree of super-cooling according to claim 2 of the present invention comprises reducing a pressure by the pressure reduction means to an evaporation pressure of the evaporator over a plurality of stages through at least a desired intermediate pressure; detecting whether or not the amount of the cooling medium is a desired amount by detecting in which of a gas-liquid two-phase condition and a liquid phase condition the cooling medium is immediately after the pressure reduction to the desired intermediate pressure; judging, when the desired intermediate pressure is lower than a pressure on a saturation liquid line when the desired amount of the cooling medium is charged into the refrigeration circulation system, that the desired amount of the cooling medium is charged when the cooling medium is in the gas-liquid two-phase condition at this intermediate pressure, and excess cooling medium is charged when the cooling medium is in the liquid phase condition at this intermediate pressure; and further judging, when the desired intermediate pressure is higher than a pressure above the saturation liquid line when the desired amount of the cooling medium is charged into the refrigeration circulation system, that the desired amount of the cooling medium is charged when the cooling medium is in the liquid phase condition at this intermediate pressure, and the cooling medium is insufficient when the cooling medium is in the gas-liquid two-phase condition at this intermediate pressure.

In a refrigeration circulation system which includes a compressor for compressing a gaseous cooling medium, a condenser for cooling the gaseous cooling medium compressed by the compressor and converting it to a liquid cooling medium, first pressure reduction means for reducing the pressure of the cooling medium converted to the liquid cooling medium by the condenser and converting it to an atomized cooling medium, and an evaporator for subjecting the cooling medium atomized by the first pressure reduction means to heat-exchange with air, and in which the cooling medium on the inlet side of the first pressure reduction means has a certain degree of super-cooling, a cooling medium charge amount detector for detecting whether or not an actual amount of a cooling medium is a desired amount in comparison with an amount of the cooling medium necessary for having a desired degree of super-cooling, the detector according to claim 3 of the present invention comprises second pressure reduction means disposed in parallel with the first pressure reduction means, for reducing the pressure of the cooling medium flowing from the condenser to an evaporation pressure at the evaporator over a plurality of stages through at least a desired intermediate pressure; and detection means for detecting whether the cooling medium immediately after the pressure reduction to the desired intermediate pressure is in a gas-liquid two-phase condition or in a liquid phase condition; wherein the detection means detects whether the phase condition is a gas-liquid two-phase condition indicating that the desired amount of the cooling medium is charged or a liquid phase condition indicating that excess cooling medium is charged, when the desired intermediate pressure described above is lower than a pressure on a saturation liquid line when the desired amount of the cooling medium is charged into the refrigeration circulation system; and the detection means detects whether the cooling medium is in the liquid phase condition representing that the desired amount of the cooling medium is charged or the gas-liquid two-phase condition representing that the cooling medium is insufficient, when the desired intermediate pressure described above is higher than a pressure on the saturation liquid line when the desired amount of the cooling medium is charged into the refrigeration circulation system.

In the refrigeration cycle which includes a compressor for pompressing a gaseous cooling medium, a condenser for cooling the gaseous cooling medium compressed by the compressor and converting it to a liquid cooling medium, and an evaporator for subjecting the cooling medium flowing out from the condenser and atomized to heat-exchange with air, and in which the cooling medium on the outlet side of the condenser has a certain degree of super-cooling, a cooling medium charge amount detector for detecting whether or not an actual amount of a cooling medium is a desired amount in comparison with an amount of the cooling medium necessary for having a desired degree of super-cooling, according to claim 4 of the present invention, comprises pressure reduction means disposed between the condenser and the evaporator, for reducing the pressure of the liquid cooling medium flowing from the condenser to an evaporation pressure of the evaporator over a plurality of stages through at least a desired intermediate pressure; and detection means for detecting whether the cooling medium immediately after the pressure reduction to the desired intermediate pressure by the pressure reduction means is a gas-liquid two-phase condition or in a liquid phase condition; wherein the detection means detects whether the phase condition is in the gas-liquid two-phase condition representing that the desired amount of the cooling medium is charged, or in the liquid phase condition representing that excess cooling medium is charged, when the desired intermediate pressure is lower than a pressure on a saturation liquid line when the desired amount of the cooling medium is charged into the refrigeration circulation system; and the detection means detects whether the phase condition is in the liquid phase condition representing that the desired amount of the cooling medium is sealed or in the gas-liquid two-phase condition representing that the cooling medium is insufficient, when the desired intermediate pressure is higher than the pressure on the saturation liquid line when the desired amount of the cooling medium is charged into the refrigeration circulation system.

According to the cooling medium seal amount detection method and detector according to claims 1 and 3 of the present invention, the second pressure reduction means reduces the pressure over a plurality of stages through at least a desired intermediate pressure. Whether or not the amount of the cooling medium is the desired amount is judged by detecting the phase condition of the cooling medium after the pressure is reduced to the desired intermediate pressure by this second pressure reduction means.

After the pressure is reduced to the desired intermediate pressure, the cooling medium is in the gas-liquid two-phase condition when the intermediate pressure is lower than a pressure on a saturation liquid line, and is in the liquid phase condition when the intermediate pressure is higher than the pressure on the saturation liquid line.

Accordingly, the desired amount of the cooling medium can be judged as being charged if the phase condition is found to be the gas-liquid two-phase condition after the pressure of the cooling medium is reduced to a pressure lower than the pressure on the saturation liquid line when the desired amount of the cooling medium necessary for providing the desired super-cooling degree is charged, and the phase condition is then detected at this pressure.

After the pressure of the cooling medium is reduced to a pressure lower than the pressure on the saturation liquid line when the desired amount of the cooling medium is charged, the phase condition at this pressure is then detected. If the phase condition at this time is found to be the liquid phase condition, the pressure on the practical saturation liquid line can be judged as being lower than the pressure after the pressure reduction. Therefore, the pressure difference between the pressure of the cooling medium on the inlet side of the pressure reduction means and the pressure when the pressure is reduced to the condition on the saturation liquid line, is greater than the pressure difference when the desired amount of the cooling medium is charged. This pressure difference is proportional to the degree of super-cooling and the degree of super-cooling is proportional to the charge amount of the cooling medium. Accordingly, when the cooling medium after the pressure reduction is in the liquid phase condition and the pressure difference is great, it is possible to judge that excess cooling medium is charged.

On the other hand, the pressure of the cooling medium is reduced to a pressure higher than the pressure on the saturation liquid line when the desired amount of the cooling medium is charged, and the phase condition at this pressure is detected. If the phase condition is found to be the liquid phase condition, it is possible to judge that the desired amount of the cooling medium is charged.

The pressure of the cooling medium is reduced to a pressure higher than the pressure on the saturation liquid line when the desired amount of the cooling medium is charged, and the phase condition at this pressure is detected. If the phase condition at this time is the gas-liquid two-phase condition, it is possible to judge that the pressure on the actual saturation liquid line is higher than the pressure after the pressure reduction. Accordingly, the pressure difference between the pressure of the cooling medium on the inlet side of the pressure reduction means and the pressure after pressure reduction of the cooling medium to the pressure on the saturation liquid line is smaller than the pressure difference when the desired amount of the cooling medium is charge. This pressure difference is proportional to the degree of super-cooling, and the degree of super-cooling is proportional to the charge amount of the cooling medium. Accordingly, when the cooling medium after the pressure reduction is in the gas-liquid two-phase condition and the pressure difference is small, it is possible to judge that the cooling medium is insufficient.

As described above, the cooling medium charge amount detection method and detector according to the present invention can detect whether the amount of the cooling amount in the refrigeration circulation system is suitable, insufficient or excessive in comparison with the desired amount.

The cooling medium charge amount detection method and detector according to claims 2 and 4 reduces the pressure by the pressure reduction means over a plurality of stages through at least a desired intermediate pressure. Whether the amount of the cooling medium inside the refrigeration cycle is suitable, insufficient or excessive with respect to the desired amount can be detected by detecting the phase condition of the cooling medium after this pressure reduction, in the same way as the invention as set forth in claims 1 and 3.

These and other objects and features of the present invention will become more apparent from the following description when taken in conjunction with the accompanying drawings.

BRIEF DESCRIPTION OF THE DRAWINGS

FIG. 1(*b*) is a sectional view taken along a line 1—1 of FIG. 1(*a*);

FIG. 14(*b*) is a sectional view taken along a line 14—14 of FIG. 14(*a*);

FIG. 17(*b*) is an explanatory view showing the condition at the point B2 in FIG. 16;

FIG. 17(*c*) is an explanatory view showing the condition at the point B1 in FIG. 16;

FIG. 18(*b*) is a sectional view taken along a line 18—18 of FIG. 18(*a*);

FIG. 23(*b*) is a Mollier diagram;

FIG. 24(*b*) is a sectional view showing the cooling medium charge amount detector.

DESCRIPTION OF THE PREFERRED EMBODIMENTS

Hereinafter, a cooling medium charge amount detection method according to an embodiment of the present invention and an apparatus used for the method will be explained with reference to the drawings.

Figure 4:
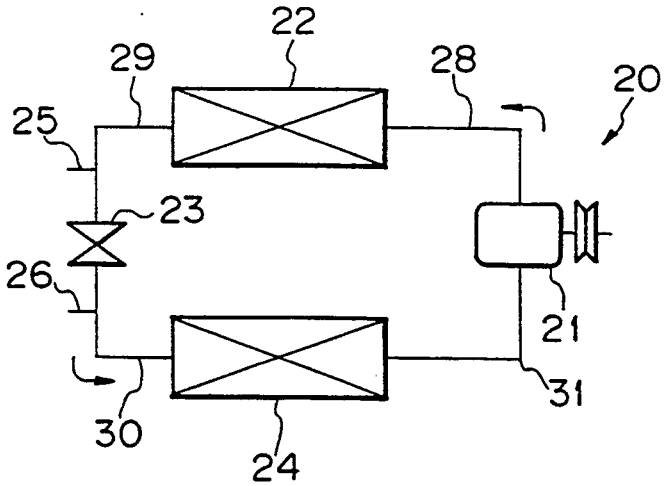
FIG. 4 is a diagram showing a refrigeration circulation system using the cooling medium seal amount detector of the present invention.
Figure 5:
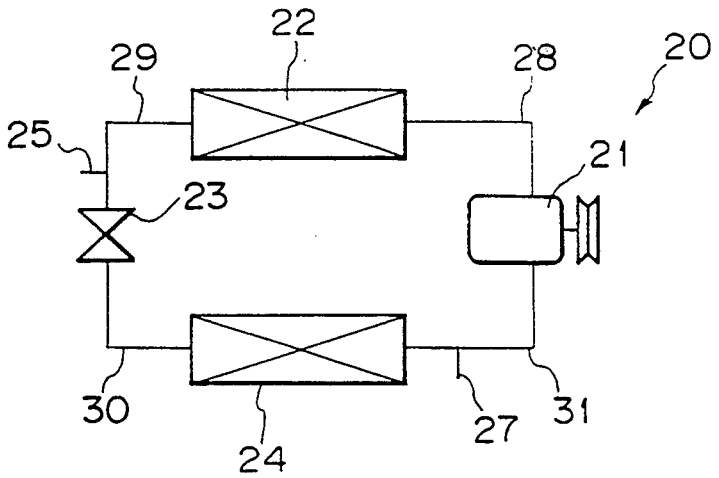
FIG. 5 is a diagram showing the refrigeration circulation system using the cooling medium charge amount detector of the present invention.
Figure 6:
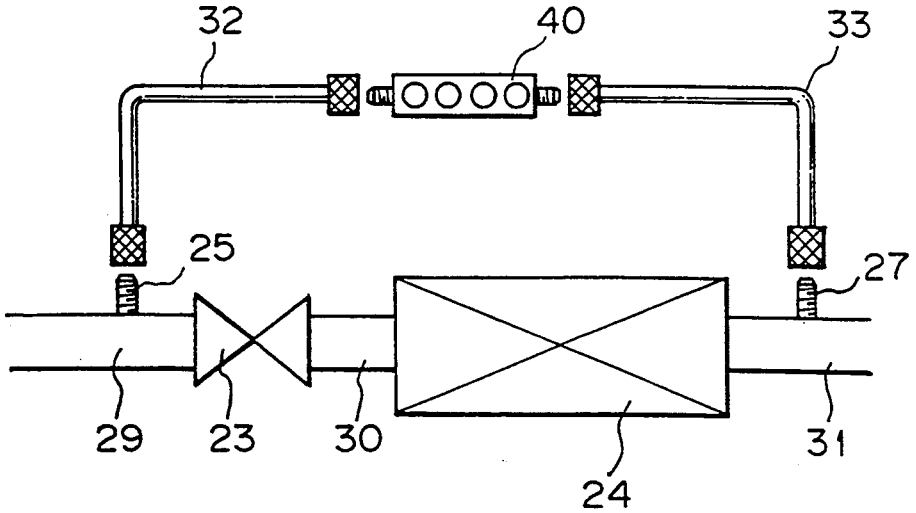
FIG. 6 is a connection diagram when the cooling medium charge amount detector of the present invention is used.

As shown in FIGS. 4 and 5, a refrigeration circulation system 20 includes a compressor 21 for compressing a gaseous cooling medium, a condenser 22 for cooling the gaseous cooling medium compressed by the compressor 21 and converting it to a liquid cooling medium, an expansion valve 23 for reducing the pressure of the liquid cooling medium converted to a liquid by the condenser 22 and expanding it to the cooling medium in a mist form, and an evaporator 24 for subjecting the cooling medium atomized by this expansion valve 23 to heat-exchange with air.

Figure 16:
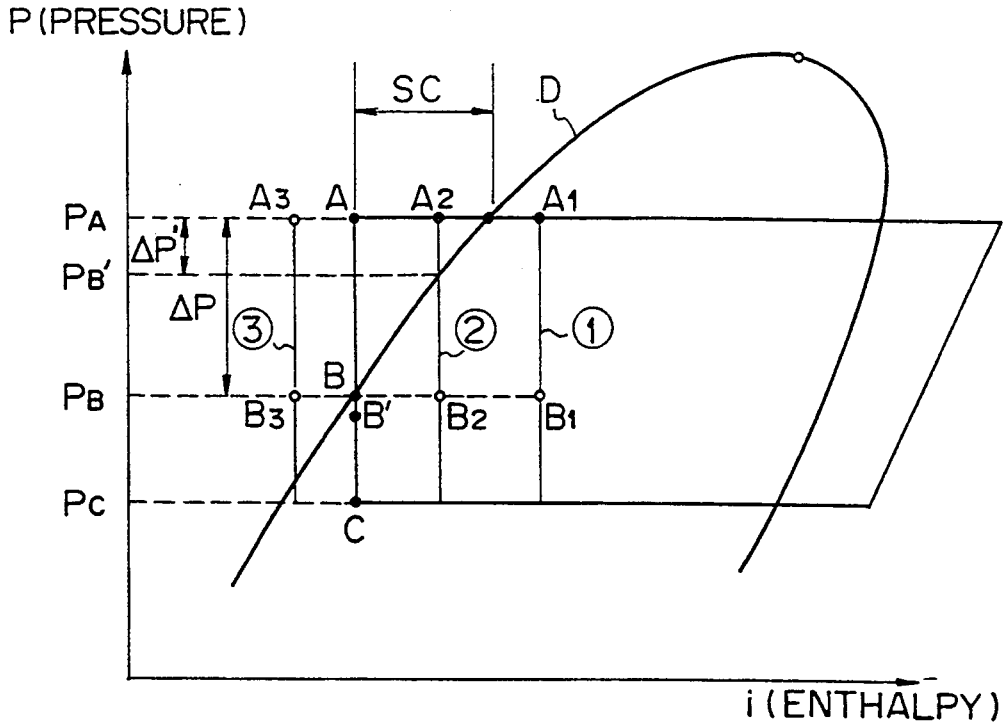
FIG. 16 is a Mollier diagram.

When a suitable amount of the cooling medium is charged into the refrigeration circulation system 20, the cooling medium is super-cooled by the condenser 22 and comes to have a degree of supercooling SC as shown in FIG. 16, as is known in the art. Incidentally, this degree of supercooling is proportional to the charge amount of the cooling medium in the refrigeration circulation system 20, and the greater the amount of the cooling medium, the greater becomes the degree of supercooling SC.

Next, a method of detecting whether or not an actual amount of the cooling medium is a desired amount with respect to the amount of the cooling medium necessary to attain a desired degree of supercooling SC (sub-cool quantity) in this refrigeration circulation system 20 will be explained.

As shown in the Mollier diagram of FIG. 16, in the cooling medium under the condition A having a degree of supercooling and a cooling medium realized by reducing this cooling medium under condition A to the condition B on a saturation liquid line D, the pressure difference $\Delta P$ ($=PA-PB$) between the pressure PA of the cooling medium under condition A and the pressure PB of the cooling medium under the condition B is proportional to the degree of supercooling SC. And, the greater this value $\Delta P$, the greater the degree of supercooling SC.

According to the detection of the cooling medium charge amount of the present invention, the pressure of the cooling medium under the condition A on the inlet side of the expansion valve 23 is reduced by the pressure difference $\Delta P$ corresponding to the degree of supercooling SC when a desired amount of the cooling medium is charged into the refrigeration cycle, and the condition of the cooling medium in the pressure reduction state is detected. When a desired and suitable amount of the cooling medium is charged, the condition of the cooling medium, the pressure of which is reduced by the pressure difference $\Delta P$, is on the saturation liquid line. Whether or not the cooling medium charge amount is suitable is judged by comparing the condition of the cooling medium on this saturated liquid line D and the actual condition of the cooling medium.

In an apparatus comprising one throttle 56 and sight glass 57*a*, 57*b* disposed upstream and downstream of this throttle 56 as shown in FIG. 9, this apparatus is connected to each of small valves 25 and 26 disposed upstream and downstream of the expansion valve 23 shown in FIG. 4 in such a manner that the cooling medium inside the refrigeration cycle 20 flows into each apparatus. The diameter of the aperture of the throttle 56 is determined in advance so that the pressure can be reduced by the pressure difference $\Delta P$ corresponding to the suitable degree of supercooling SC.

Next, an explanation will be given for the case where a gas is charged when an engine is in an idling state and a blower air rate is under the maximum H1 condition.

When the cooling medium is charged into the refrigeration circulation system 20, a gaseous phase is established at both the inlet and outlet of the throttle 56 as shown in FIG. 9(*a*) because the amount of the cooling medium is not sufficient at the beginning. As the cooling medium is further charged into the refrigeration circulation system 20, the two-phase gas-liquid exists at the inlet of the throttle 56 as shown in FIG. 9(*b*), but the gaseous phase is established at the outlet due to expansion by the throttle 56.

Figure 9A:
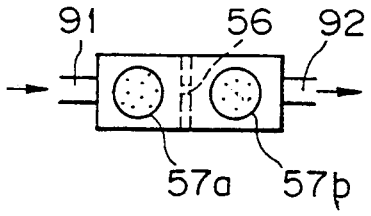
FIGS. 9(*a*), (*b*), (*c*), (*d*) and (*e*) are diagrams showing each temperature condition.
Figure 9B:
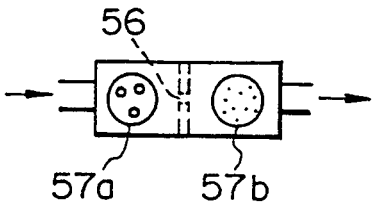
Figure 9C:
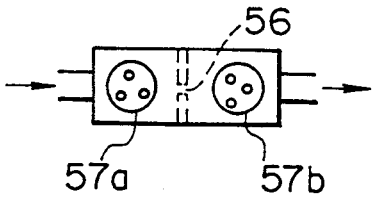
Figure 9D:
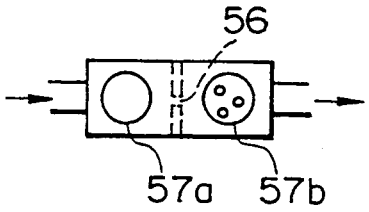
Figure 9E:
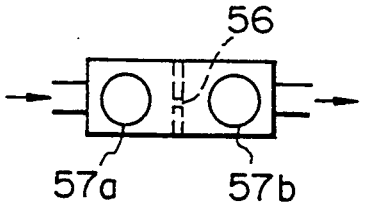

As the cooling medium is further charged, the cooling medium is under the condition A1 at the inlet of the throttle 26 and is under the condition B1 at the outlet as shown in the cycle ① of FIG. 16. In this state, the gas-liquid two-phase exists at both the inlet and outlet of the throttle 56 as shown in FIG. 9(c). At this time, the amount of the cooling medium is clearly insufficient because the two-phase gas-liquid exists at the inlet of the throttle 56 and the degree of supercooling SC does not exist.

As the cooling medium is further charged, the cooling medium is under the condition A2 at the inlet of the throttle 56 and is under the condition B2 at the outlet of the throttle 56 as shown in the cycle ② in FIG. 16. At this time, the liquid single phase exists at the inlet of the throttle 56 and the two-phase gas-liquid exists at the outlet of the throttle 56 as shown in FIG. 9(*d*).

When the cooling medium is further sealed into the refrigeration circulation system 20, the cooling medium is under the condition A3 at the inlet of the throttle 56 and is under the condition B3 at the outlet of the throttle 56 as shown in ③ of FIG. 16. At this time, the liquid phase exists at both inlet and outlet of the throttle 56 as shown in FIG. 9(*e*).

When the amount of the cooling medium corresponds to the suitable degree of supercooling SC, the condition becomes the condition B on the saturation liquid line D when the pressure of the cooling medium on the inlet side of the expansion valve 23 is reduced by the pressure difference $\Delta P$. This condition is between the condition shown in FIG. 9(*d*) and the condition shown in FIG. 9(*e*), and the time at which the gas-liquid two-phase shifts to the liquid phase after pressure reduction at the throttle 56, is judged as the time when the amount of the cooling medium having a suitable degree of supercooling is charged.

Figure 7:
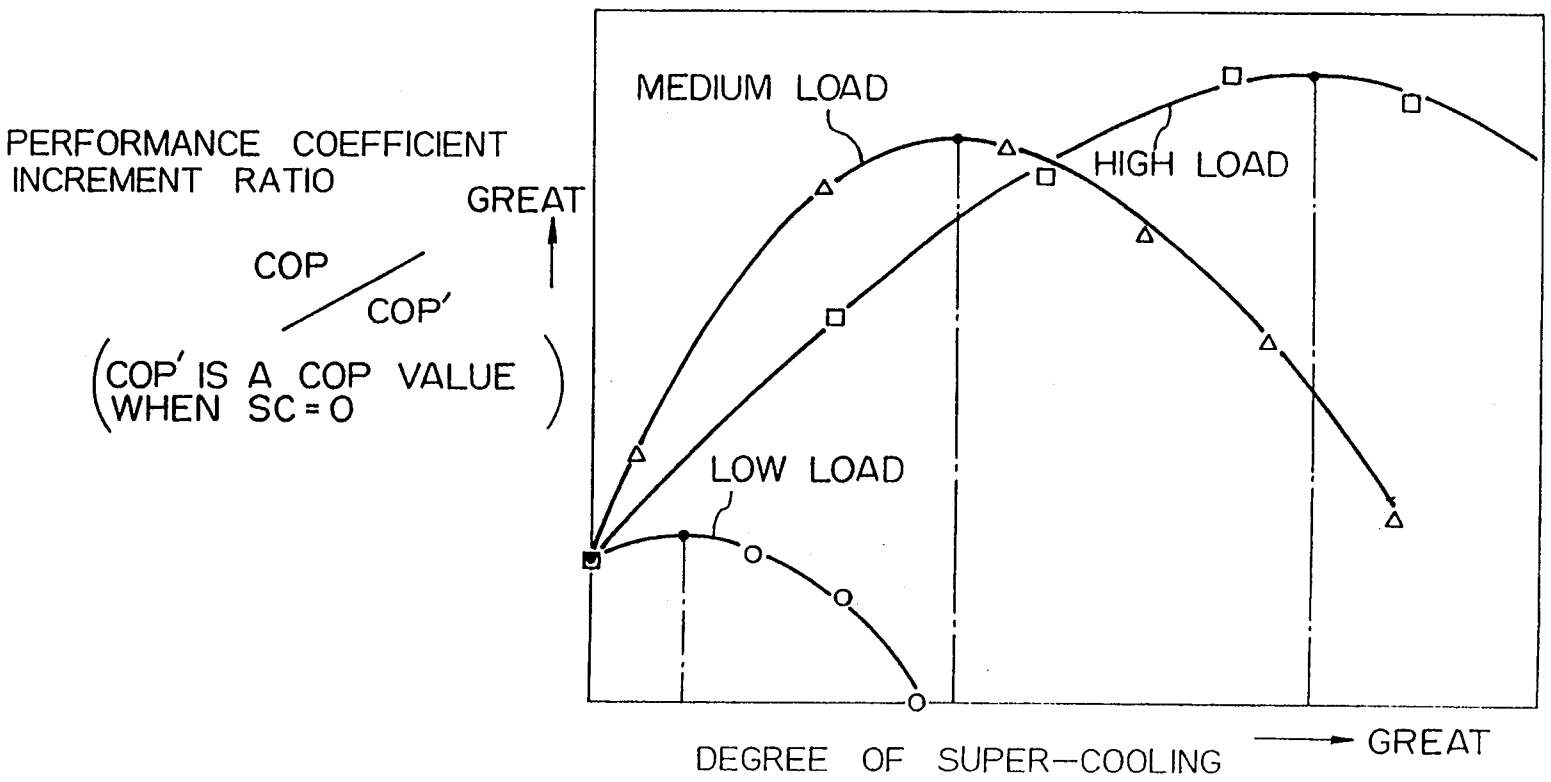
FIG. 7 is a diagram showing the relation between a degree of super-cooling and a coefficient of performance increment ratio.

Incidentally, it is known that in a refrigeration circulation system having a sub-cool (sub-cool circulation system), the optimum supercooling coefficient which provides the highest performance coefficient changes with external temperature conditions (load). When the external temperature condition is changed at three levels of a low load such as in winter, a medium load such as in spring and fall, and a high load such as in summer, the relation between a degree of supercooling SC at the inlet of the expansion valve 23 and the performance coefficient COP is shown in FIG. 7. The performance coefficient COP is expressed by a ratio to the performance coefficient COP' at the time when the degree of supercooling SC is 0° C. It can be understood that a curve is an upwardly protrusive graph with respect to the cooling medium flow rate (load) under each condition, and a degree of supercooling SC (optimum subcool amount) which makes the performance coefficient COP maximum exists.

Figure 8:
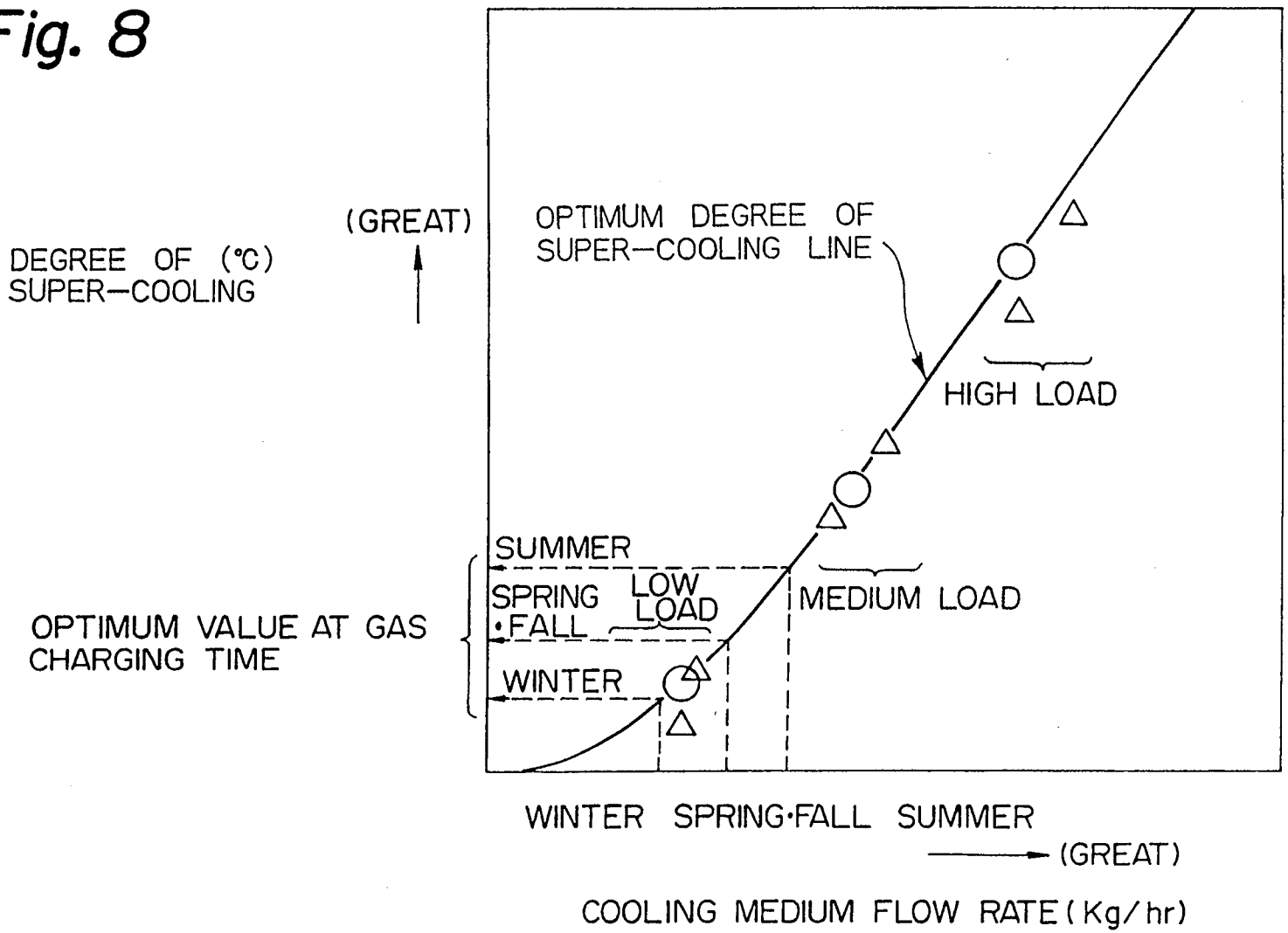
FIG. 8 is a diagram showing the relation between a flow rate of the cooling medium and the degree of super-cooling.

As also shown in the relational diagram between the cooling medium flow rate (load) and the degree of supercooling in FIG. 8, the greater the cooling medium flow rate and the higher the load, the greater becomes the optimum degree of supercooling.

The first embodiment of the present invention, which takes the factors described above into consideration will be explained with reference to FIGS. 1 to 8.

Figure 1A:
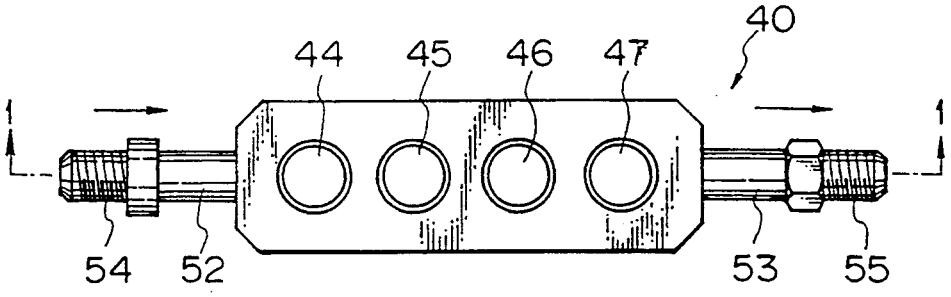
FIG. 1(*a*) is a top view of a cooling medium charge amount detector according to the first embodiment of the present invention.
Figure 1B:
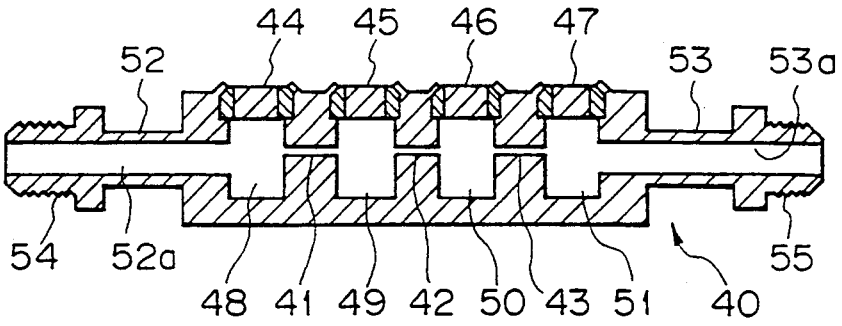

As shown in FIG. 1(*b*) which is a sectional view taken along a line 1—1 of FIG. 1(*a*), the cooling medium charge amount detector 40 of the present invention includes a first throttle 41, a second throttle 42 and a third throttle 43 which have the same diameter and are disposed from the upstream side to the downstream side. The detector 40 includes a flow passage 48 on the upstream side (left side in the drawing) of the first throttle 41, a flow passage 49 between the first and second throttles 41, 42 a flow passage 50 between the second and third throttles 42, 43, and a flow passage 51 on the downstream side (right side in the drawing) of the third throttle 43, and site glasses 44, 45, 46, 47 are disposed upstream of the respective flow passages 48, 49, 50, 51 in such a manner that the inside can be inspected, so as to detect the condition of the cooling medium flowing into each flow passage.

A cylindrical piping is disposed so as to guide the cooling medium to the upstream side of the passage 48, and a piping 53 is disposed on the downstream side of the passage 51 so as to discharge the cooling medium flowing through the flow passages 48, 49, 50, 51. Screw portions 54, 55 having a male screw threaded therein are disposed at the end portions of both pipings 54, 55.

The diameter of the throttles 41, 42, 43 is smaller by about 1/6 than the diameter of the flow passage 52*a* inside the piping 52 and the diameter of the flow passage 53*a* in the piping 53. The throttles 41, 42, 43 all have the same diameter. These throttles 41, 42, 43 reduce the flow rate of the cooling medium flowing into this apparatus 40 to about 1/10 of the flow rate of the cooling medium flowing inside the refrigeration circulation system. More specifically, the diameter of the throttles 41, 42, 43 is set to be about 0.5 mm so that the flow rate of the cooling medium flowing into this apparatus 40 becomes 12 to 13 l/hr. The flow passages 48, 49, 50, 51 have a greater diameter than the flow passages 52*a*, 53*a* inside the pipings as shown in the drawing.

The sectional area of the flow passages 48, 49, 50, 51 is greater than that of the flow passages 52*a*, 53*a* inside the pipings 52, 53 as shown in the sectional view of FIG. 1(*b*), but it may be equal to that of the flow passages 52*a*, 53*a* inside the pipings.

Figure 2:
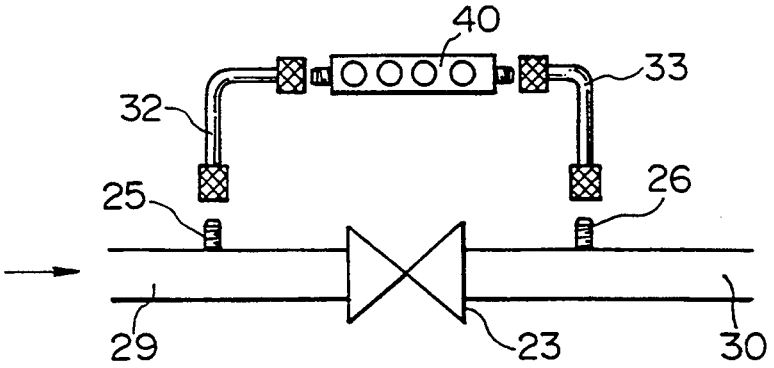
FIG. 2 is a connection diagram when the cooling medium charge amount detector of the present invention is used.
Figure 3:
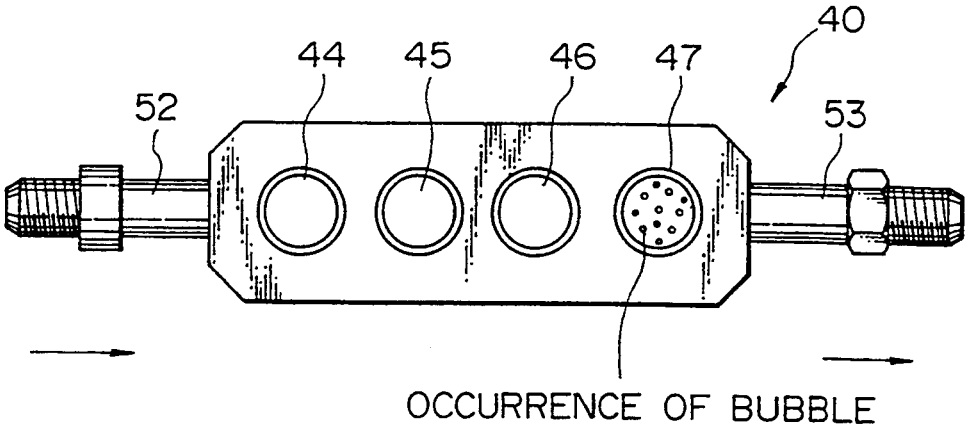
FIG. 3 is a top view showing the cooling medium charge amount detector according to the first embodiment of the present invention.

In the refrigeration circulation system 20, small valves 25, 26 are disposed in a piping 29 on the inlet side of the expansion valve 23 and in a piping 30 on the outlet side of the expansion valve 23 as shown in FIGS. 2 and 4. These small valves 25, 26 permit the inflow of the cooling medium inside the refrigeration cycle 20 into the cooling medium charge amount detector 40 when flexible hoses 32, 33 are connected to allow communication of the detector 40 with the pipings 29, 30, but inhibit the outflow of the cooling medium inside the refrigeration circulation system when the flexible hoses 32, 33 are not connected.

While this cooling medium charge amount detector 40 is connected to the refrigeration circulation system 20 by the flexible hoses 32, 33, power of the engine (not shown in the drawing) of a vehicle is transmitted to the compressor 21 so as to operate the refrigeration circulation system 20 and the air-conditioner. Then the cooling medium flows to the expansion valve 23 as normally. The cooling medium also flows into the cooling medium charge amount detector 40, due to the pressure difference between the pressure on the inlet side of the expansion valve 23 occurring at this time and the pressure on the outlet side of the expansion valve 23.

The pressure can be reduced by the throttles 41, 42, 43 inside this cooling medium charge amount detector 40 over several stages through desired intermediate pressures, and whether or not the cooling medium seal amount is suitable can be judged by observing the bubbles at the sight glasses 44, 45, 46, 47.

Next, the operation of this cooling medium charge amount detector 40 will be explained with reference to the Mollier diagram of FIGS. 13(*a*), (*b*) and (c).

Figure 13A:
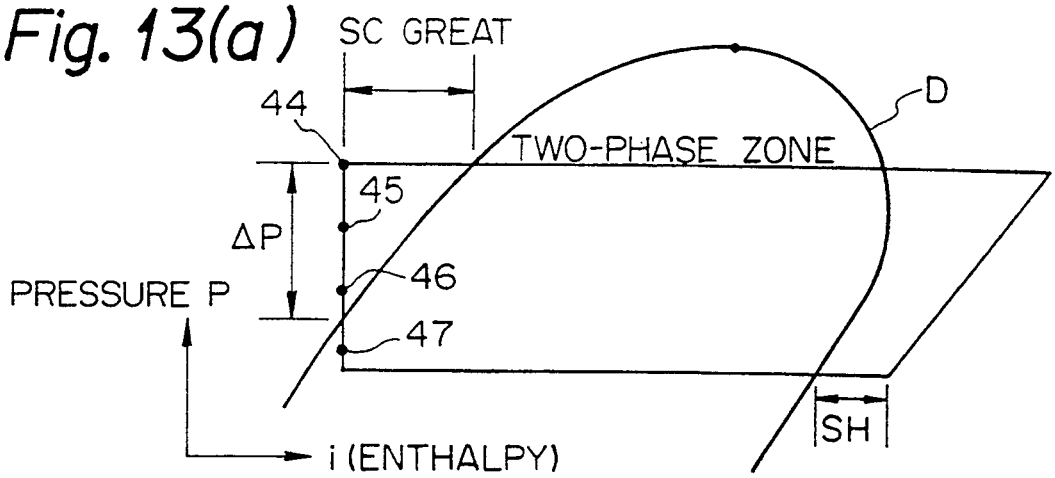
FIGS. 13(*a*), (*b*) and (*c*) are Mollier diagrams.
Figure 13B:
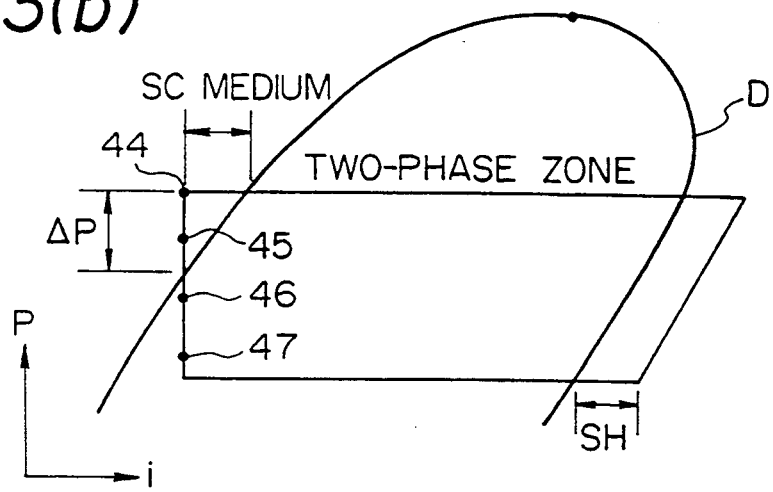
Figure 13C:
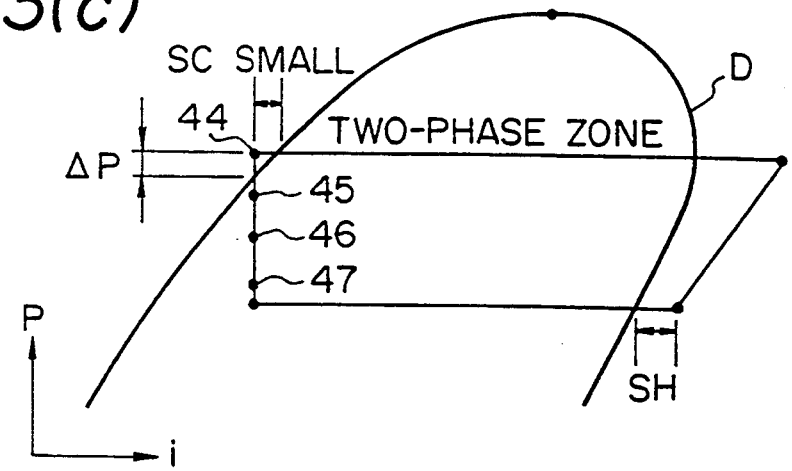

As shown in FIG. 13(c), since the optimum degree of supercooling SC is small at the time of a low load, the pressure difference ΔP between the pressure on the inlet side of the expansion valve 23 and the pressure on the saturation liquid line D is small. Accordingly, the cooling medium is in the liquid single phase state at the first sight glass 44 which is the closest to the inlet before the cooling medium is subjected to the pressure reduction, but after the pressure is reduced by the first throttle 41, the pressure is reduced to be lower than the pressure difference ΔP, and the optimum cooling medium charge amount is attained when the condition changes to the two-phase gas-liquid condition. This two-phase gas-liquid condition can be confirmed by eye by observing the bubbles at the second sight glass 45.

At the time of the medium load shown in FIG. 13(*b*), the pressure difference ΔP corresponding to the optimum degree of supercooling SC is medium. Therefore, after the pressure reduction by the first throttle 41, the cooling medium is in the liquid phase condition but after the pressure is reduced by the second throttle 42, the cooling medium seal amount having the optimum subcool amount is attained when the cooling medium enters the two-phase gas-liquid condition. This condition can be detected by confirming the liquid single phase condition through the first and second sight glasses 44, 45 and confirming the gas-liquid two-phase state through the third and fourth sight glasses 46, 47.

At the time of the high load shown in FIG. 13(*a*), the optimum degree of supercooling SC is great. Therefore, the pressure difference ΔP between the pressure on the inlet side of the expansion valve 23 and the pressure on the saturation liquid line D is great. Accordingly, the cooling medium is in the liquid phase condition after the pressure reduction by the first and second throttles 41, 42, and the cooling medium seal amount having the optimum degree of supercooling is attained when it is in the two-phase gas-liquid condition after the pressure reduction by the third throttle 43.

As described above, the pressure difference ΔP changes in accordance with the optimum degree of supercooling SC which changes with the load. The pressure reduction by the pressure difference ΔP can be made in accordance with the load by one apparatus by disposing the throttles 41, 42, 43 in series and disposing the sight glasses 44 to 47 upstream and downstream of these throttles. In other words, it is possible to know after the pressure reduction to what extent from the inlet side of the expansion valve 23 the actual condition on the saturation liquid line D exists, by inspecting the phase condition of the cooling medium before and after the pressure reduction through the site glasses 44 to 47.

This pressure reduction amount, that is, the pressure difference ΔP, is proportional to the charge amount of the cooling medium. Therefore, whether or not the charge amount of the cooling medium is suitable with respect to the desired amount can be checked.

Figure 10:
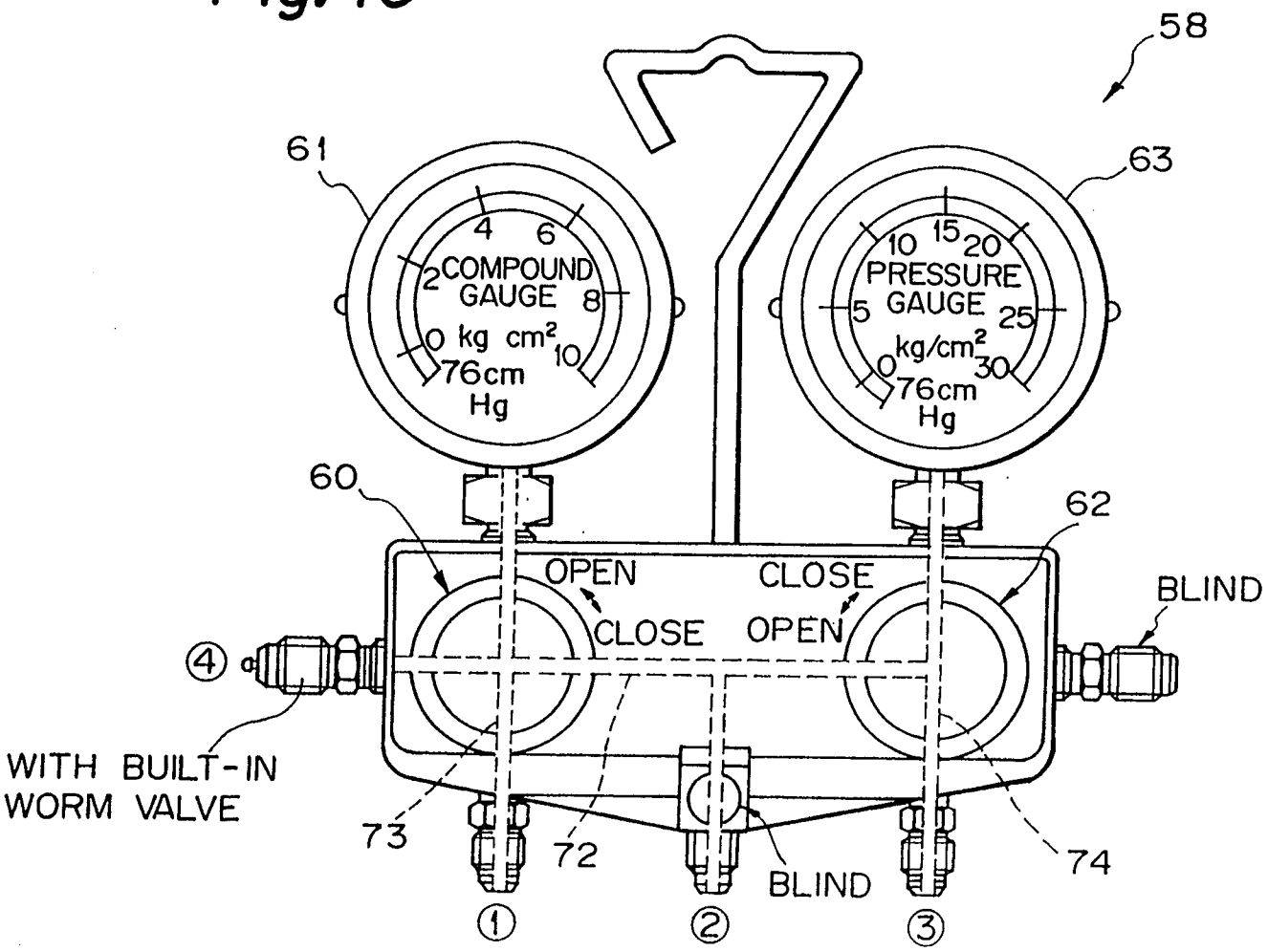
FIG. 10 is a schematic view showing a gauge manifold.

The low, medium and high conditions of the load are judged by measuring the pressure PH on the high pressure side by a gauge manifold 58 (see FIG. 10) as a service tool which is to be used at the time of charging of normal gas. For example, the load is judged as the high load when the high pressure PH is PH>16 [kgf/cm$^2$] at the time of charging of the cooling medium (engine: idling, blow air rate: Hi), as the medium load when the high pressure PH satisfies the relation 13 [kgf/cm$^2$]≦PH≦16 [kgf/cm$^2$] and as the low load when the high pressure PH satisfies the relation PH>13 [kgf/cm$^2$ ]. Incidentally, the gauge manifold 58 comprises four screw portions ①, ②, ③, ④ two values 60, 62 and two pressure gauges 61, 63. This gauge manifold 58 communicates the high pressure piping 29 of the refrigerator with the screw portion ③ of the gauge manifold 58 by a charging hose which connects the small valves 25, 26, 27 of the pipings 29, 30, 31 to the screw portions of the gauge manifold 58. At the same time, it connects the small valve 26 of the low pressure piping 30 with the screw portion ① of the gauge manifold 58. Thus, it is a known service tool which charges the gas while connecting the high pressure to the low pressure.

This gauge manifold 58 includes a first communication passage 73 for communicating the screw portion ① with the low pressure gauge 61, a second communication passage 74 for communicating the screw portion ③ with the high pressure gauge 63 and a third communication passage 72 which is disposed in a direction that extends straight with the first and second communication passages 73, 74 and allows the screw portion ④ to communicate with the first communication passage 73, the second communication passage 74 and the screw portion ②. When the low pressure valve 60 is open, the first communication passage 73 communicates with the third communication passage 72 and when it is closed, the first communication passage 73 and the second communication passage 72 do not communicate with each other. When the high pressure valve 62 is open, the second communication passage 74 communicates with the third communication passage 72, and when the value is closed, the second communication passage 74 and the third communication passage 72 do not communicate with each other. The cooling medium flow passage is constituted by opening and closing these two valves 60, 62.

When both of the low pressure valve 60 and the high pressure valve 62 are closed, the first communication passage communicates with the second communication passage 74 but the second communication passage 72 is closed, so that the screw portion ② does not communicate with the screw portion ④ and the screw portion ① does not communicate with the screw portion ③, as shown in FIG. 11(*a*). Accordingly, the low pressure gauge 61 communicates with the screw portion ① while the high pressure gauge 63 communicates with the screw portion ③.

Figure 12:
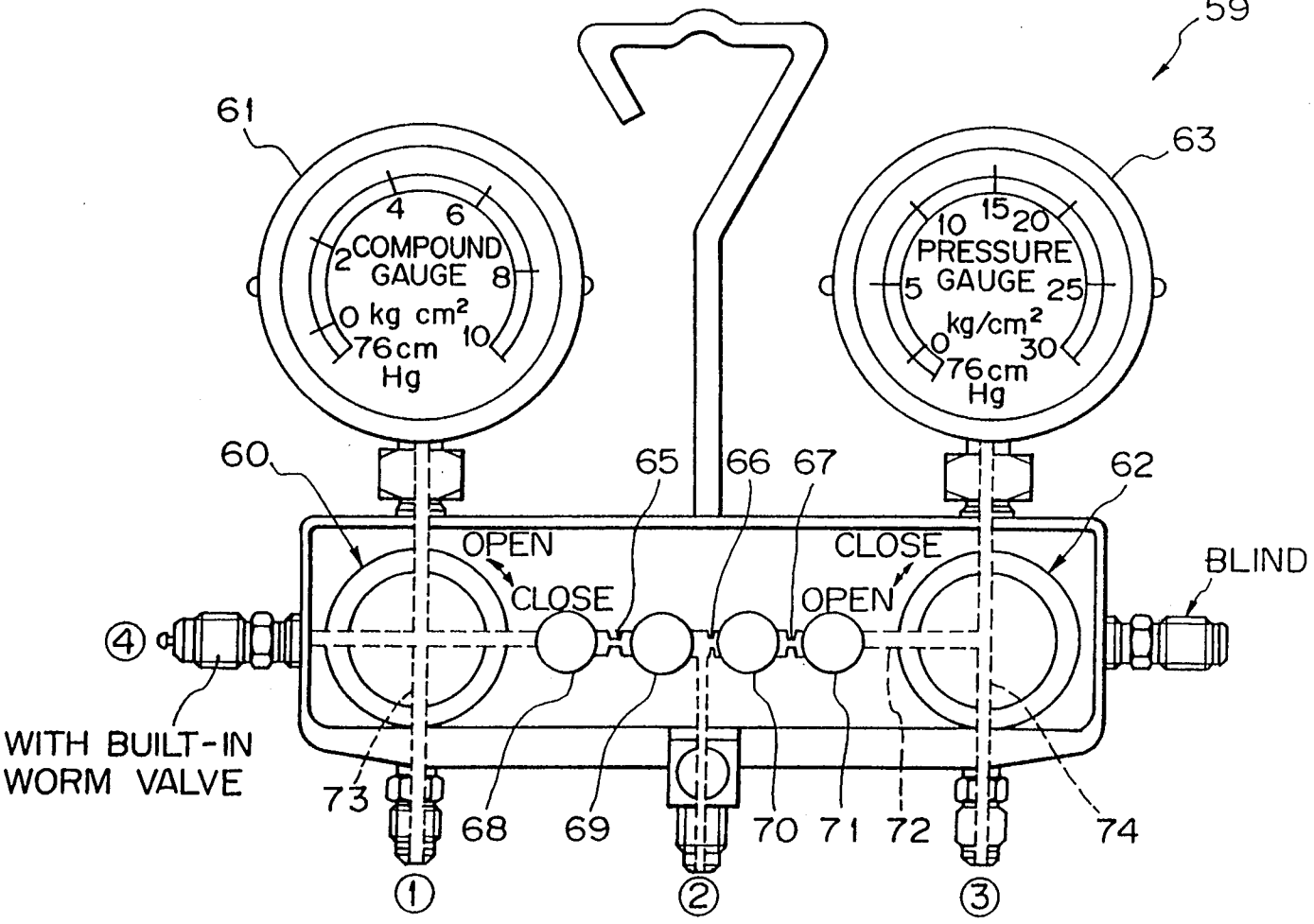
FIG. 12 is a schematic view showing the second embodiment of the present invention.

When the high pressure valve 62 is closed with the low pressure valve 60 kept open, the first communication passage 73 communicates with the third communication passage 72 and the second communication passage 74 does not communicate with the third communication passage 72 as shown in FIG. 12(*b*). Accordingly, the low pressure gauge 61 communicates with the screw portion ①, the screw portion ② and the screw portion ④, while the high pressure gauge 63 communicates with the screw portion ③.

Figure 11A:
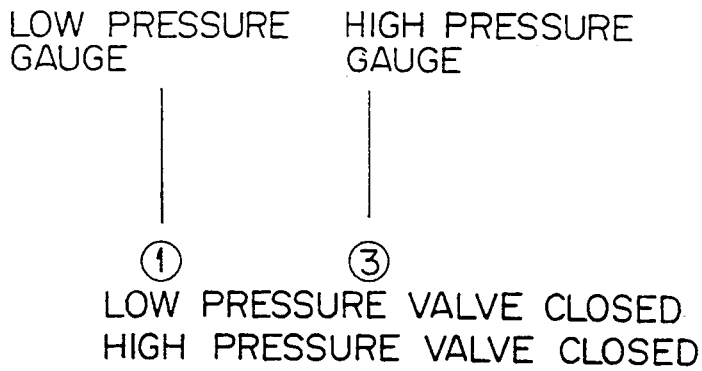
FIGS. 11(*a*), (*b*), (*c*) and (*d*) show each flow passage of the gauge manifold.
Figure 11B:
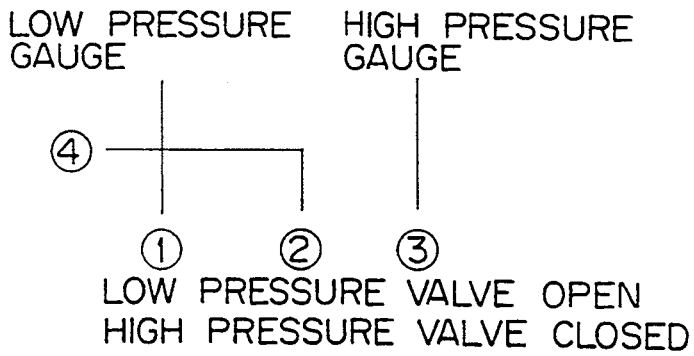
Figure 11C:
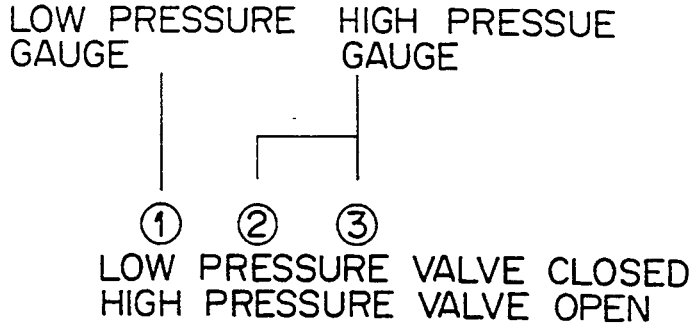
Figure 11D:
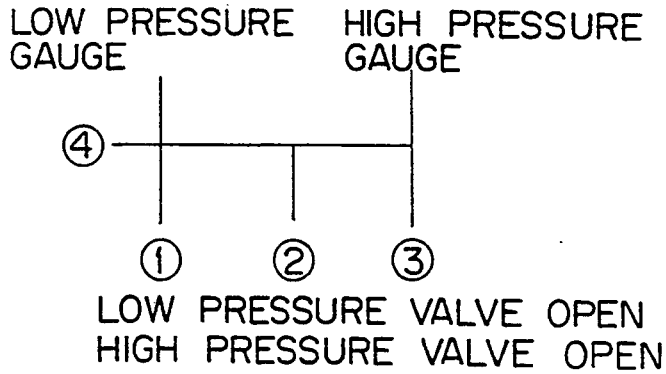

When the low pressure valve 60 is closed and the high pressure valve 62 is open, the second communication passage 74 communicates with the third communication passage 72 as shown in FIG. 11(c) whereas the first communication passage 73 and the third communication passage 72 do not communicate with each other. Accordingly, the low pressure gauge 61 communicates with the screw portion ① and the high pressure gauge 63 communicates with the screw portion ② and the screw portion ③.

When both of the low pressure valve 60 and the high pressure valve 62 are closed, the first communication passage 73, the second communication passage 74 and the third communication passage 72 communicate with one another as shown in FIG. 11(*d*). Accordingly, both of the gauges 61, 63 communicate with the screw portions ①, ②, ③ and ④.

To measure the low pressure and the high pressure, measurement is carried out by closing both of the valves 60 and 62 and connecting the screw portion ① to the small valve 26 of the low pressure piping 30 and the screw portion ③ to the small valve 25 of the high pressure piping 29 as shown in FIG. 11(*a*).

Next, the second embodiment of the present invention is shown in FIG. 12.

This second embodiment relates to a gauge manifold 59 with throttles, which is obtained by assembling the cooling medium charge amount detector 40 of the first embodiment of the present invention in a gauge manifold 58 as shown in FIG. 12. As shown in this drawing, the gauge manifold 59 is an apparatus formed by disposing throttles 65, 66, 67 for detecting the cooling medium seal amount and sight glasses 68, 69, 70, 71 in the third communication passage 72 of the gauge manifold 58.

Hereinafter, the operation when the cooling medium is initially charged using this gauge manifold 59 with throttles will be explained. First of all, the screw portion ① is connected to the small valve 26 of the low pressure piping 30 of a refrigerator, the screw portion ② is connected to a cooling medium tank or a service tank (not shown) storing therein the cooling medium, the screw portion ③ is connected to the small valve 25 of the high pressure piping 29 between the condenser 22 and the expansion valve 23, and the screw portion ④ is connected to the vacuum pump, using the charging hoses.

Next, both of the two valves 60, 62 are opened, and both of the gauges 61, 63 communicate with the four screw portions ①, ②, ③, ④ as shown in FIG. 11(*d*). The vacuum pump connected to the screw portion 4 evacuates the inside of the charging hoses connected into the refrigeration circulation system 20. In this case, the valve disposed at the inlet of the cooling medium tank or the service tank is kept closed. Then, the inside of the refrigeration circulation system 20 and the inside of the charging hoses connected to the cooling medium tank or to the service tank are evacuated. After evacuation is completed, the charging hose is removed from the screw portion (4). Since the screw portion (4) has the built-in small valve, the inside of the refrigeration circulation system can be kept under vacuum even when the charging hoses are removed.

While the operation of the refrigerator is stopped, the valve at the inlet of the cooling medium tank or the service tank is opened so as to charge the cooling medium from the screw portion (2) into the refrigeration circulation system 20. Both of the low pressure gauge 61 and the high pressure gauge 63 rise as the cooling medium is charged into the refrigeration circulation system 20 and after both pressures get stabilized, the refrigerator is operated. Since the amount of the gas is not sufficient at first, the gaseous phase can be observed through all of the four sight glasses 68, 69, 70, 71. While the cooling medium is continuously charged, however, the gaseous phase changes to the liquid phase from the sight glass 71 near to the high pressure valve 74. The judgement method of the suitable seal amount is the same as that of the first embodiment. The load state is judged under the high pressure condition.

When the cooling medium is charged using this gauge manifold 59 equipped with the throttles, the valve at the inlet of the service tank is opened from the screw portion 2 to charge a suitable of the cooling medium, and after the passage of a little time from closing of the valve, the condition is judged from the sight glass. If the amount of the cooling medium is not sufficient, the valve is opened once again to charge a suitable amount of the cooling medium into the refrigeration circulation system, and after the condition gets stabilized, it is judged from the site glass. This operation is repeatedly carried out.

The embodiment described above employs the structure wherein the cooling medium on the inlet side of the expansion valve 23 is led into the cooling medium charge amount detector 40, and this cooling medium is allowed to flow out to the outlet side of the expansion valve 23. However, it is also possible to employ the structure wherein the small valve 27 is disposed downstream of the evaporator 24 of the refrigeration circulation system 20 and the cooling medium flowing into the coling medium charge amount detector 40 is allowed to flow out to the outlet side of the evaporator 24. By the way, the cooling medium flowing out from the cooling medium charge amount detector 40 is under the two-phase gas-liquid condition but changes to the cooling medium in the gaseous phase as it is heated by the gaseous cooling medium having the degree of superheating by the evaporator 24. Accordingly, the degree of heating after the evaporator 24 drops, but the cooling medium in the two-phase gas-liquid does not flow into the compressor 21. Accordingly, no problem occurs at all.

To use the present apparatus for the air-conditioner for a vehicle, the expansion valve 23 and the evaporator 24 are disposed in one unit and are assembled in the inside of the vehicle. Therefore, it is difficult to dispose the small valve 26 in the piping 30 between the expansion valve 23 and the evaporator 24 and to fit the flexible hose 33 to this small valve 26 in the same way as in the construction shown in FIG. 4. Accordingly, a higher operation factor can be obtained by disposing the small valves 25, 27 in the pipings 29, 31 disposed inside the hood outside the room of the vehicle in the same way as in the construction shown in FIG. 5.

In the first and second embodiments described above, the cooling medium inside the refrigeration circulation system 20 is guided from the inlet side of the expansion valve 23 into the cooling medium seal amount detector 40, the gas-liquid condition of the cooling medium is detected at both ends of each of a plurality of throttles and is then allowed to flow towards the outlet side. According to this structure, it becomes possible to detect to which extent the pressure reduction is to be made so as to attain the two-phase gas-liquid condition by checking when the liquid phase condition of the cooling medium changes to the two-phase gas-liquid before and after which throttles, in accordance with the respective load condition. In other words, it is possible to detect the pressure difference between the pressure PA of the cooling medium under the condition A and the pressure PB of the cooling medium under the condition B in FIG. 16. Accordingly, it becomes possible to detect whether or not a suitable amount of the cooling medium, which provides a suitable degree of supercooling inside the refrigeration circulation system 20, is charged into the refrigeration circulation system 20.

By the way, the cooling medium seal amount detector 40 according to the first embodiment of the present invention employs the construction wherein it is connected to the refrigeration circulation system 20 only when the cooling medium is charged and the amount of the cooling medium is detected. However, it may of course be kept connected always to the refrigeration circulation system 20 of the vehicle.

Next, the third embodiment of the present invention will be explained with reference to FIGS. 14 to 17.

Figure 14A:
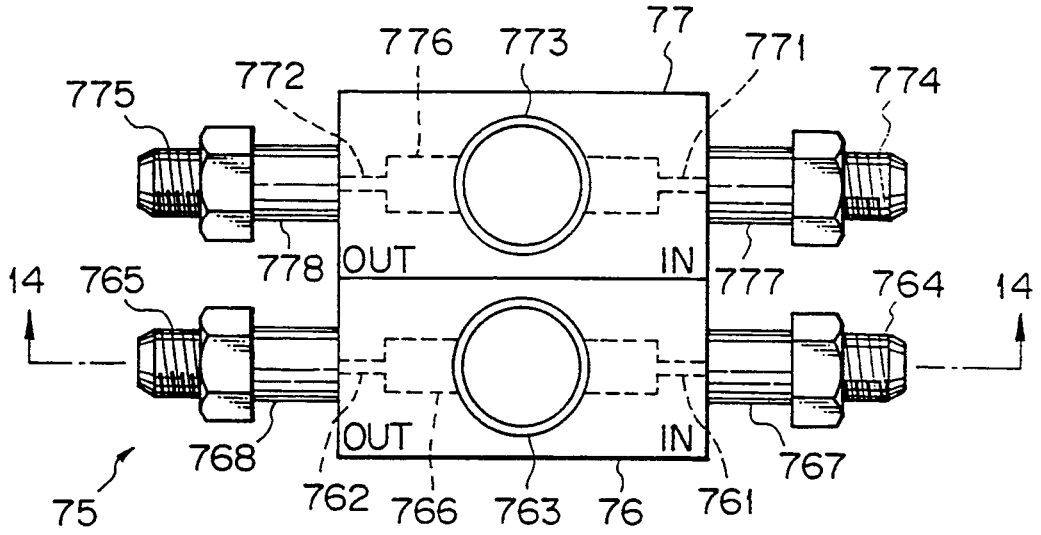
FIG. 14(*a*) is a top view showing the third embodiment of the present invention.
Figure 14B:
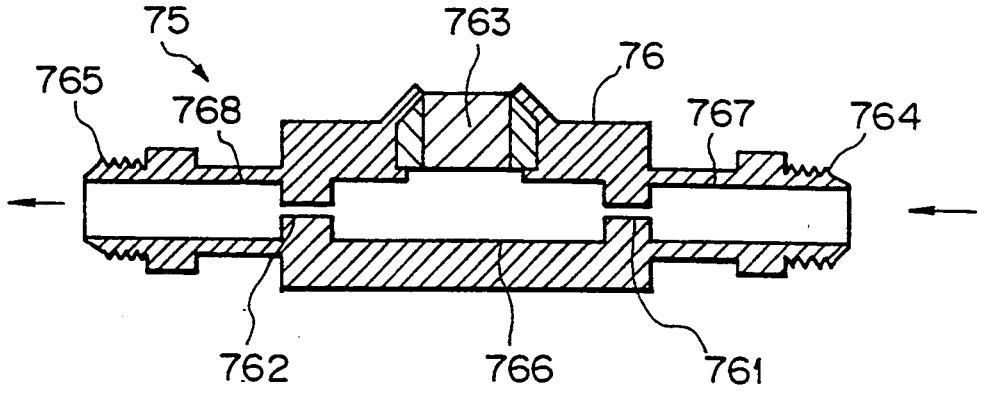

As shown in FIG. 14, the cooling medium charge amount detector 75 of this embodiment includes a first detection unit 76 equipped with throttles for spring, summer and fall (for medium and high loads) and a second detection unit 77 equipped with a throttle for winter (for a low load) that are disposed in parallel with each other.

The first detection unit 76 includes a fixed throttle 761 for spring, summer and fall, which is disposed on the upstream side, a fixed throttle 763 for regulating a reduced pressure, which is disposed on the downstream side, and a sight glass 763 for detecting the phase condition of the cooling medium in a flow passage 766 between these throttles. An inlet piping 767 for leading the cooling medium to this flow passage 766 is disposed at the fixed throttle 761 on the opposite side to the flow passage 766, and an outlet piping 768 for discharging the cooling medium flowing into the flow passage 766 from this fixed throttle 761 is disposed on the downstream side of the flow passage 766. Screw portions 764, 765 having a male screw threaded therein are formed at both end portions.

The second detection unit 77 includes a fixed throttle 771 for winter, a fixed throttle 772 for regulating the pressure reduction, which is disposed on the downstream side, and a sight glass 733 for detecting the phase condition of the cooling medium in a flow passage 776 between these throttles. Pipings 777, 778 for guiding the cooling medium to this flow passage 776 are disposed on the opposite side with respect to the throttles 771, 772. Screw portions 774, 775 having a male screw threaded therein are disposed at both end portions.

As shown in FIG. 16, the fixed throttle 761 for spring, summer and fall and the fixed throttle 771 for winter reduce the pressure of the cooling medium on the inlet side of the expansion valve 23 by the pressure difference ΔP corresponding to the suitable degree of supercooling to match the load condition. In FIG. 16, they convert the cooling medium on the inlet side of the expansion valve 23 under the condition A to the cooling medium on the saturation liquid line D under the condition B. The cooling medium on the inlet side of the expansion valve 23, which has the pressure PA under the condition A, is subjected to pressure reduction to the pressure PC under the condition C by the expansion valve 23. The fixed throttles 762, 772 for regulating the pressure reduction are disposed so as to reduce the pressure by the same pressure as the pressure difference (PA−PC) before and after this expansion valve 23.

In the first embodiment, the measurement can be made for each of the three load conditions, that is, the low, medium and high load conditions shown in FIG. 8, but in this embodiment, the throttles for the medium and high loads are combined into one throttle and this throttle is used for the medium and high loads.

Figure 15:
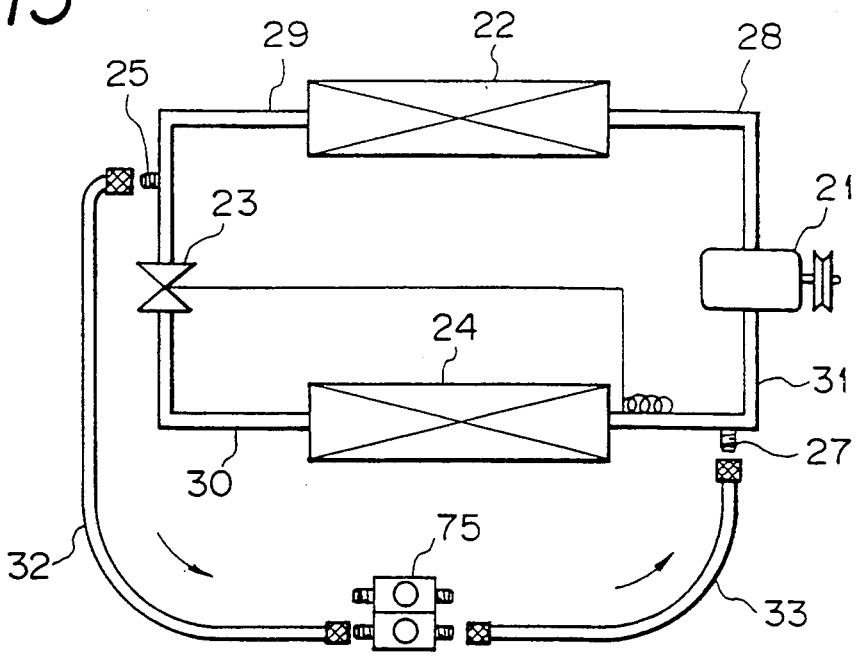
FIG. 15 is a block diagram showing the third embodiment of the present invention when connected to the refrigeration circulation system.

The cooling medium seal amount detector 75 connects either of the first and second detection units 76, 77 to the small valve 25 of the high pressure side piping 29 and the small valve 27 of the low pressure side piping 31 of the refrigeration circulation system by the flexible hoses 32, 33 in accordance with the season and the load at the time of detection as shown in FIG. 15.

When the cooling medium seal amount is detected in summer using this cooling medium charge amount detector 75, for example, the first detection unit 76 is connected and used through the flexible hoses 32, 33.

According to this cooling medium charge amount detector 75, the cooling medium on the inlet and high pressure side of the expansion valve 23 in the refrigeration circulation system is caused to flow into the flow passage other than those of the refrigeration circulation system 20. The pressure of this cooling medium is reduced by the pressure difference ΔP (=PA−PB) corresponding to the supercooling degree SC inside the refrigeration circulation system 20 as shown in FIG. 16. The pressure difference ΔP between the pressure PA of the cooling medium having the degree of supercooling SC and the pressure PA when the pressure of this cooling medium is reduced to the condition B on the saturation liquid line is proportional to the supercooling degree SC. Accordingly, whether the cooling medium, the pressure of which is reduced by the predetermined pressure ΔP corresponding to the suitable degree of supercooling SC, is the two-phase gas-liquid or the liquid phase is detected.

When the condition is under the two-phase gas-liquid condition after the pressure reduction by the predetermined pressure WP, the pressure is much more reduced than the condition on the saturation liquid line. Therefore, the condition can be judged as the condition under with the degree of supercooling SC is small as in the condition A2 on the inlet side of the expansion valve 23 and the condition is the condition B2 after the pressure reduction. Therefore, the practical pressure difference ΔP′ (=PA−PB′) between the pressure PA of the cooling medium on the inlet side of the expansion valve 23 and the pressure PB′ of the cooling medium on the saturation line can be detected as being smaller than the predetermined pressure difference ΔP. Since the pressure difference is proportional to the degree of supercooling, the degree of supercooling SC, too, is smaller than a predetermined quantity when the practical pressure difference ΔP′ is smaller than the predetermined pressure difference ΔP′, and insufficiency of the cooling medium can thus be detected.

When the condition after the reduction of the pressure by the predetermined pressure is in the liquid phase condition, it is the condition B on the saturation liquid line or the condition under which the pressure is reduced by only a small degree from the former. Accordingly, the practical pressure difference can be detected as being greater than the pressure difference ΔP. At this time, the degree of supercooling SC is above the predetermined quantity, and the quantity of the cooling medium can be detected as being more than the suitable quantity.

Practically, however, when the cooling medium is first charged into the refrigeration circulation system, the suitable amount of the cooling medium should have been charged and the amount of the cooling medium never increases. Therefore, when the condition is the liquid phase condition, the amount is judged as being the cooling medium seal amount having a suitable degree of supercooling.

Detection of the charge amount when the cooling medium is charged will now be explained.

Figure 17A:
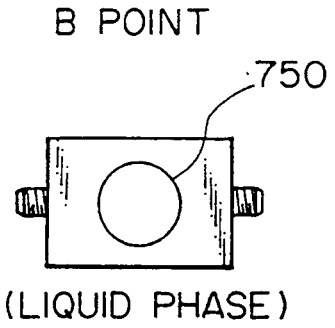
FIG. 17(*a*) is an explanatory view showing the condition at the point B of FIG. 16.
Figure 17B:
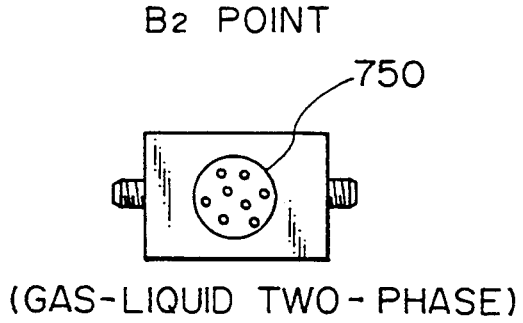
Figure 17C:
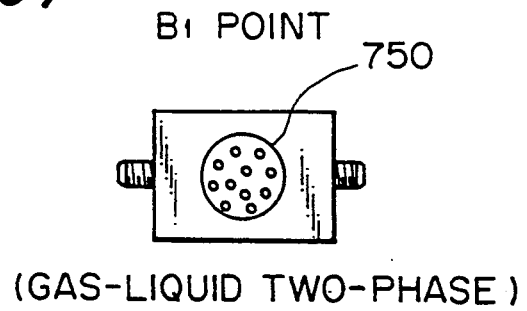

As the cooling medium is gradually charged, the condition is first the two-phase gas-liquid condition as the condition A1 on the inlet side of the expansion valve 23 (a sight glass for detecting the condition A of the cooling medium on the inlet side of the expansion valve 23 does not exist) because the amount of the cooling medium is small at the beginning, and the condition B1 of the cooling medium, the pressure of which is reduced by the predetermined pressure by the fixed throttle 761, seems to be in the two-phase gas-liquid condition as shown in FIG. 17.

After the cooling medium is charged and sub-cooling is awaited inside the refrigeration circulation system, the condition on the inlet side of the expansion valve 23 becomes the liquid phase condition as the condition A2 as shown in FIG. 16. However, because the degree of supercooling SC is small, the condition B2 of the cooling medium, the pressure of which is reduced by the predetermined pressure by the fixed throttle 761, enters the two-phase gas-liquid condition as shown in FIG. 17.

As the amount of the cooling medium gradually increases, the condition of the cooling medium, the pressure of which is reduced by the predetermined pressure by the fixed throttle 761, switches to the liquid phase as shown in FIG. 17. This point of time corresponds to the condition B in FIG. 16, and is the point when the cooling medium corresponding to the desired pressure reduction quantity ΔP is charged into the refrigeration circulation system. Accordingly, when charging of the cooling medium is stopped under this condition, the amount of the cooling medium having the desired subcool quantity can be attained.

When the load is the medium and high loads during charging of the cooling medium, the load condition is detected by connecting the first detection unit 76 to the refrigeration circulation system 20 to detect the condition, and when the load is the low load, the load condition is detected by connecting the second detection unit 77 to the refrigeration circulation system 20.

Incidentally, the flow rate of the cooling medium flowing into the cooling medium seal amount detector 75 is preferably set to about 1/10 of the flow rate of the cooling medium flowing into the expansion valve 23. When the flow rate of the cooling medium flowing into this detector 75 is set to 12 to 13 l/hr, the diameter of the fixed throttle 761 for spring, summer and fall is about 0.5 mm and the diameter for winter is about 0.7 mm.

The experiments carried out by the present inventor revealed the following. At a high load of an external temperature of 35° C. and a humidity of 60% under the condition where the number of revolutions of the engine is less than in the idling state and the amount of air flow from of the air conditioner is maximum during charging of the cooling medium into the refrigeration circulation system 20, the pressure difference ΔP proportional to the degree of supercooling SC for providing 8° C. is about 2.7 kgf/cm$^2$. Therefore, the pressure of the cooling medium on the inlet side of the expansion valve 23 is reduced by this pressure difference ΔP. At a medium load of an external temperature of 27° C. and a humidity of 50%, the pressure is reduced by about 1.9 kgf/cm$^2$ and at a low load of an external temperature of 20° C. and a humidity of 50%, the pressure is reduced by about 1.6 kgf/cm$^2$, and the cooling medium is charged so that the pressure at this time attains the pressure on the saturation liquid line.

Assuming that the pressure of the cooling medium on the high pressure side is 13.6 kgf/cm$^2$ and that on the low pressure side is 4.3 kgf/cm$^2$ at the medium load under the experimental condition described above, the pressure reduction quantity by the fixed throttles 761, 771 is as small as about 1.9 kgf/cm$^2$ and the pressure reduction quantity by the fixed throttles 762, 772 for regulating the pressure reduction quantity is about 11.7 kgf/cm$^2$. To reduce the pressure by about 11.7 kgf/cm$^2$, the diameter of the throttle must be shaped to have a smaller diameter than those of the fixed throttles 761, 771. Accordingly, contraction by this throttle may be made in divisions over several stages.

This embodiment employs the construction wherein the pressure is reduced by one fixed throttle to the extent corresponding to the degree of supercooling and the condition of the cooling medium after pressure reduction is inspected through the sight glass. However, the degree of supercooling SC can be correctly detected by employing the construction wherein one more throttle having a small pressure reduction quantity is disposed in the flow passages 766, 776 and one more sight glass is disposed downstream of this small throttle, so that the cooling medium subjected to the pressure reduction by the first fixed throttles 761, 771 enters the liquid phase condition as the condition B in FIG. 16, while the cooling medium subjected to the pressure reduction by the next throttle enters the gas-liquid two-phase condition such as the condition B′, and this condition can be judged most suitable. The contraction quantity by the throttle at this time is about 0.5 kgf/cm$^2$ in consideration of the fluctuation width of behavior due to the compressor, etc., and if the condition is the liquid phase condition at this pressure, it is judged as the most suitable condition.

Figure 18A:
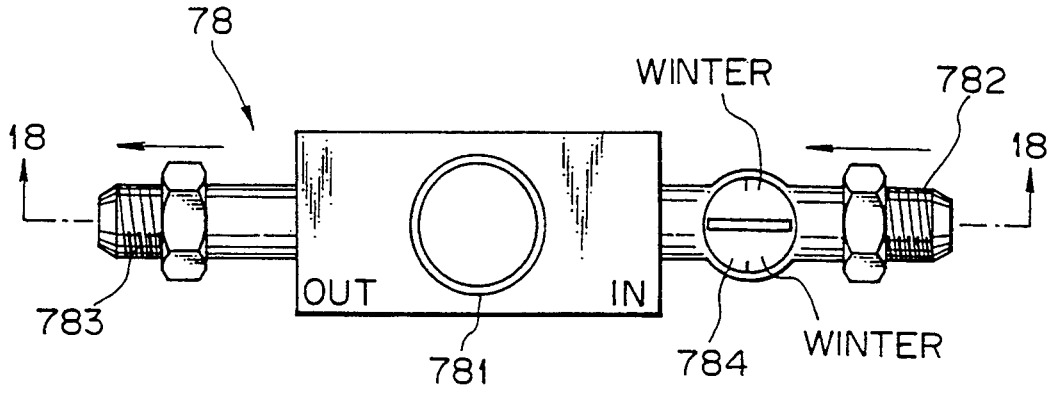
FIG. 18(*a*) is a top view showing the fourth embodiment of the present invention.
Figure 18B:
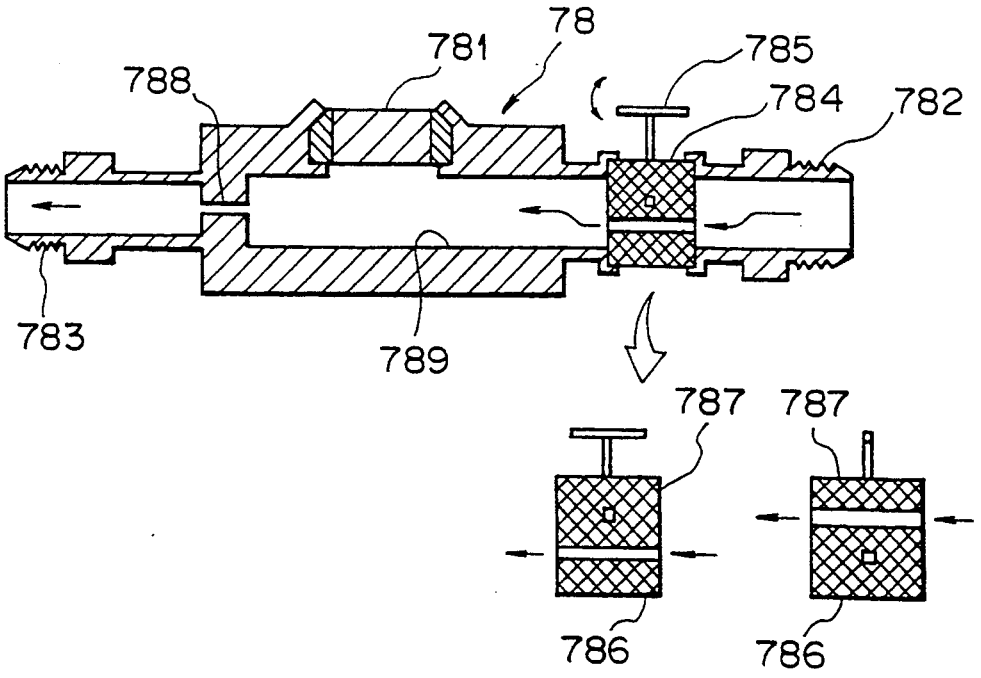

In this third embodiment, the first detection unit 76 equipped with the fixed throttle for spring, summer and fall and the second detection unit 77 equipped with the fixed throttle 771 for winter are disposed in parallel with each other. However, the detector can be constituted by only one detection unit without disposing the first and second detection units 76, 77 corresponding to the respective throttles as in the third embodiment, according to the fourth embodiment shown in FIG. 18. Namely, a throttle unit 784 equipped with a fixed throttle 786 for spring, summer and fall and a fixed throttle 787 for winter, which have diameters corresponding to the two fixed throttles 761 and 771, respectively, and capable of being rotated by 90° by a handle 784 disposed at an upper portion, is disposed as the throttle on the upstream side. The cooling medium charge amount detector 78 includes the sight glass 781, the throttle unit 784 and the fixed throttle 788 for regulating the pressure reduction quantity, and screw portions 782, 783 having a male screw threaded therein are disposed at both end portions.

The method of using this detector 78 is the same as that of the third embodiment. At the time of the medium and high loads, the handle 785 is operated in such a manner that the fixed throttle 786 for spring, summer and fall communicates with the flow passage 789 of this detector 78. At the time of the low load, the handle 785 is operated so that the fixed throttle 787 communicates with the flow passage 789.

Next, the fifth embodiment of the present invention will be explained with reference to FIG. 19.

Figure 19:
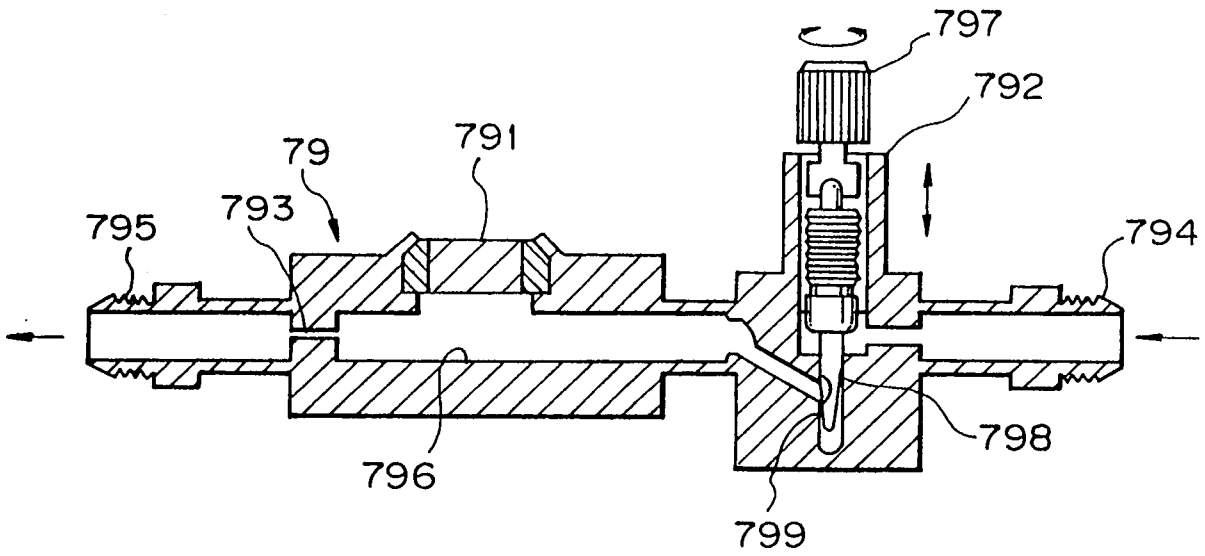
FIG. 19 is a sectional view showing the fifth embodiment of the present invention.

The fourth embodiment described above includes the throttle unit 784 having two kinds of throttles, but in the cooling medium charge amount detector according to the fifth embodiment shown in FIG. 19, a needle portion 798 which is progressively tapered towards the tip is disposed at a position corresponding to a hole 799, and a throttle portion 702 for moving this needle portion up and down with the rotation of the screw portion 792 is provided. When the screw portion 707 of this throttle 792 is rotated, the needle portion 798 moves up and down, so that the open area of the hole 799 changes. In other words, the throttle amount of the cooling medium flowing into the flow passage 796 is changed by changing this open area, and the pressure reduction quantity in accordance with the load can be controlled. This cooling medium charge amount detector 79 also includes the sight glass 791 and the fixed throttle 793 for regulating the pressure reduction quantity in the same way as in the foregoing embodiments, and the screw portions 794, 795 having the male screw threaded therein are disposed at the end portions on both sides.

Next, the sixth embodiment of the present invention will be explained with reference to FIGS. 20 and 21.

Figure 20:
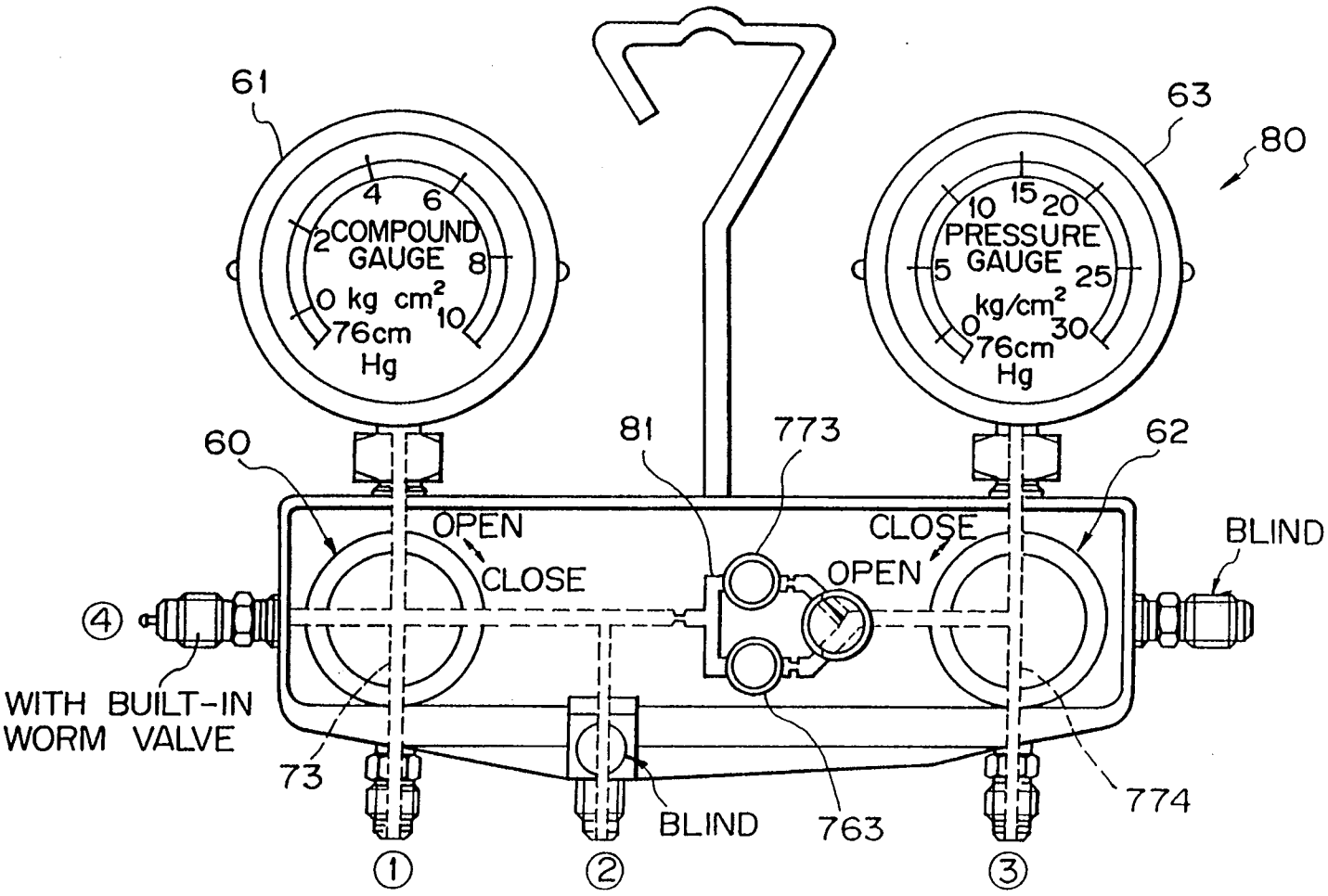
FIG. 20 is a front view showing the sixth embodiment of the present invention.
Figure 21A:
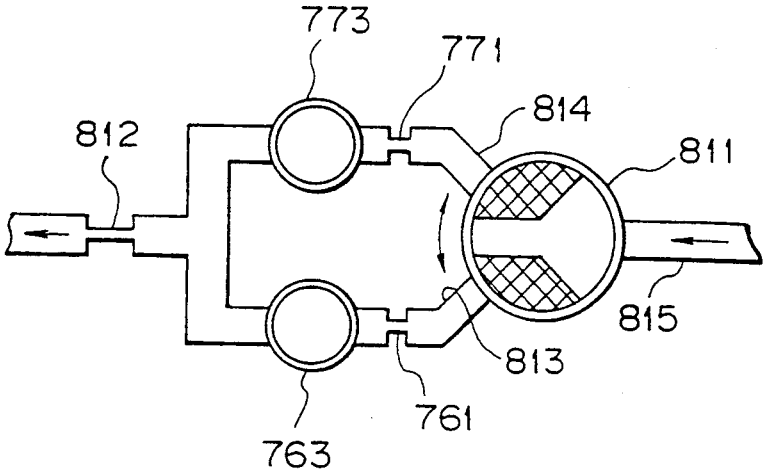
FIGS. 21(*a*) and (*b*) are schematic views showing in detail the sixth embodiment of the present invention.
Figure 21B:
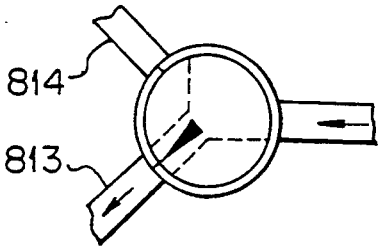

The sixth embodiment shown in FIG. 20 represents a gauge manifold 80 with a built-in throttle formed by incorporating the cooling medium amount detector 75 of the third embodiment shown in FIG. 14 in the gauge manifold 58 in the same way as the gauge manifold 59 with a built-in throttle shown in FIG. 12 which is formed by incorporating the cooling medium charge amount detector 40 in the gauge manifold 58. This gauge manifold 80 with the throttle is equipped with the cooling medium charge amount detector 81 corresponding to the cooling medium charge amount detector 75, and its detail is shown in FIG. 21. As shown in FIG. 21, the detector is equipped with a valve 811 for branching the flow passage 815 of the cooling medium from the high pressure valve 74 to either of the first and second flow passages 813 and 814. The valve 811 is rotatably disposed. When it rotates counter-clockwise as shown in FIG. 21(*b*), the flow passage 813 communicates with the flow passage 815.

When the load is judged to be the medium or high load by the high pressure gauge 63, the flow passage 815 communicates with the flow passage 813 through the valve 811 and the pressure is reduced by the fixed throttle 761 for spring, summer and fall. The phase condition at this time is judged by the sight glass 763. When the load is judged as the low load by the high pressure gauge 63, the valve 811 allows the flow passage 815 to communicate with the flow passage 813, the pressure is reduced by the fixed throttle 773 for winter, and the phase condition is judged by the sight glass 773.

Figure 22:
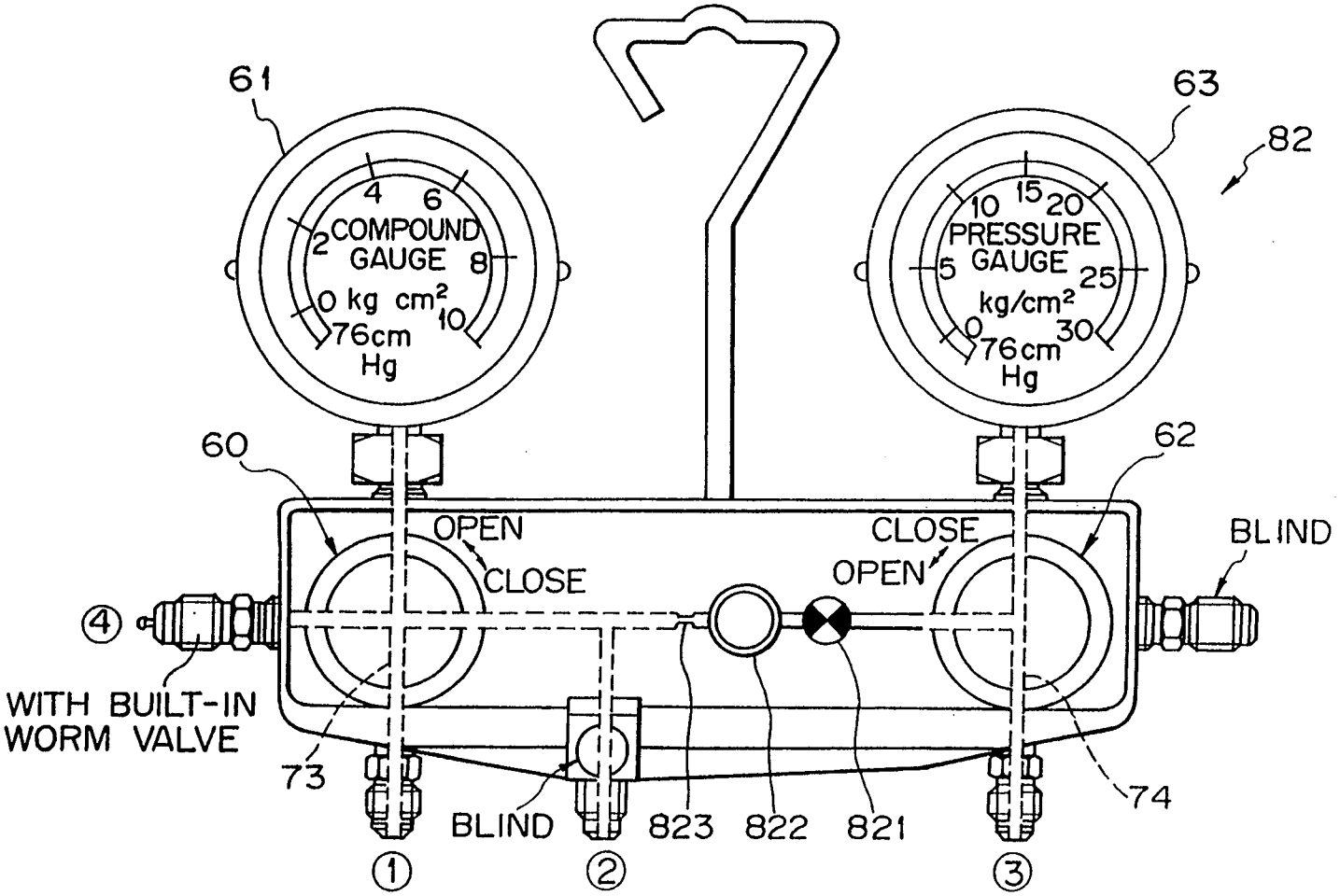
FIG. 22 is a front view showing the seventh embodiment of the present invention.

As the seventh embodiment of the present invention, it is possible to employ the construction wherein a variable throttle 821, a sight glass 822 and a fixed throttle 823 for regulating the pressure reduction quantity are disposed in the flow passage between the high pressure valve 62 and the low pressure valve 60, as shown in FIG. 22. This variable throttle 821 includes the throttle portion 784 of the fourth embodiment shown in FIG. 18 or the throttle portion 792 of the fifth embodiment shown in FIG. 19, and its operation is also the same as that of the throttle portion 784, 792.

Next, the accumulator circulation system will be explained with reference to FIG. 23.

Figure 23A:
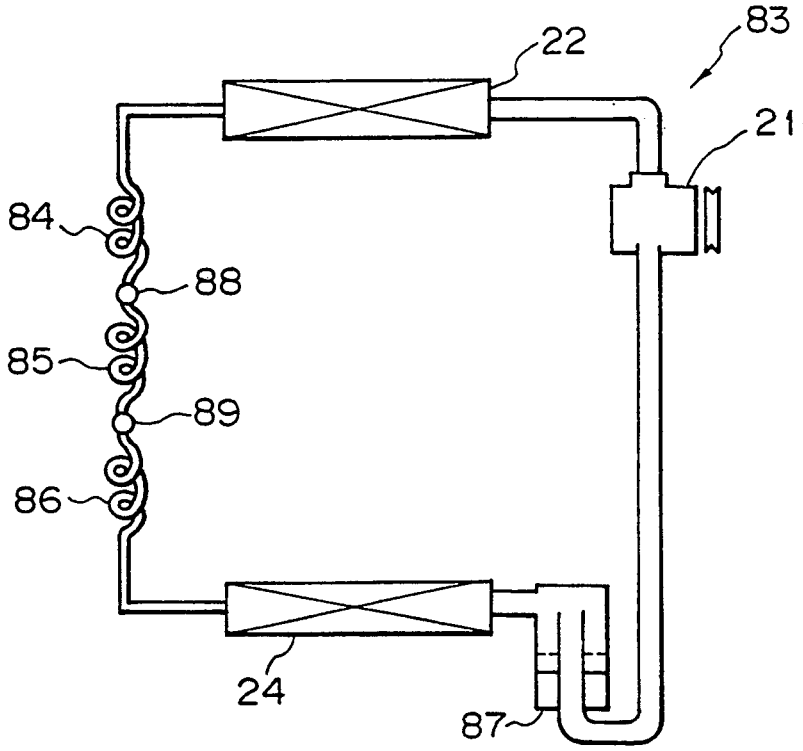
FIG. 23(*a*) is a schematic view showing another embodiment using the detector for an accumulator cycle.
Figure 23B:
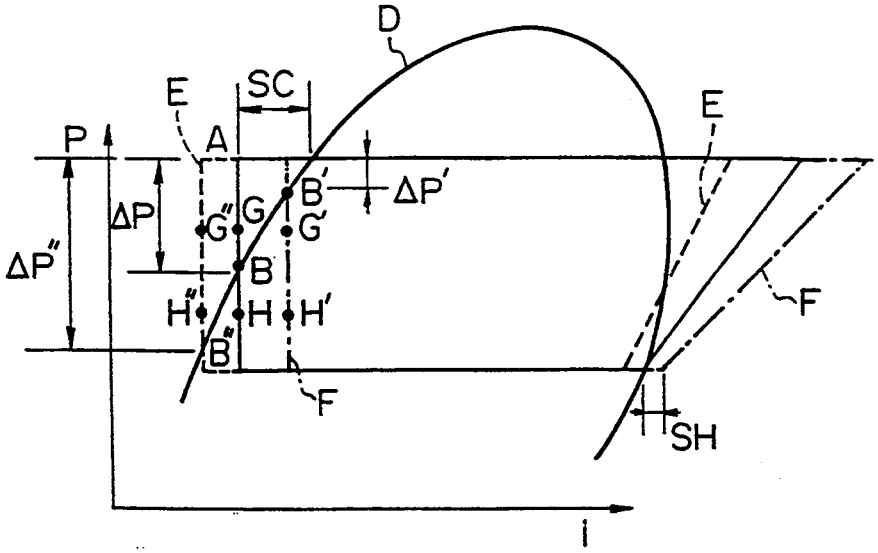

A known accumulator circulation system 83 including an accumulator 87 and a capillary tube has a degree of supercooling SC on the outlet side of the condenser 22 as shown in FIG. 23(*b*). Under the condition that the thermal load, etc., are constant, this degree of supercooling SC is solely determined by the capacity of the condenser 22 and is constant when the cooling medium is charged in the amount within the suitable range between the condition of the cycle E where the cooling medium amount is great, the liquid cooling medium stays inside the accumulator 87 and the cooling medium in the gas-liquid two-phase state flows into the compressor 21, and the cycle H where the cooling medium amount is small, the liquid cooling medium does not exist inside the accumulator 87 and the evaporator 24 has the heating degree SH.

A first capillary tube 84, a second capillary tube 85 and a capillary tube 86 are disposed as a plurality of pressure reducing devices as shown in FIG. 23(*a*). The first sight glass 88 and the second sight glass 89 are disposed between the capillary tubes 84 and 85 and between the capillary tubes 85 and 86 so as to detect the condition of the cooling medium. When a suitable amount of the cooling medium is charged, the degree of supercooling SC is constant. Therefore, the pressure difference ΔP between the pressure of the cooling medium under the condition A on the inlet side of the capillary tube 84 proportional to this degree of supercooling SC and the pressure of the cooling medium under the condition B on the saturation liquid line D is also constant.

Accordingly, the first capillary tube 84 reduces the pressure by a pressure component smaller than this pressure difference ΔP so as to make the cooling medium have the pressure under the condition G. The second capillary tube 85 further reduces the pressure of the cooling medium under the condition G after the pressure reduction by the first capillary tube 84, and the first and second capillary tubes 84 and 85 together reduce the pressure by a pressure component greater than the pressure difference ΔP so as to make the cooling medium have the pressure under the condition H. When the cooling medium in an amount falling within the suitable range is charged, the cooling medium is under the liquid phase condition under the condition G having a pressure higher than the pressure of the condition B after the pressure reduction by the pressure difference ΔP. The cooling medium under the condition H is in the two-phase gas-liquid state. Therefore, when the cooling medium in an amount falling within the suitable range is charged in the accumulator circulation system 83, the cooling medium under the gas-liquid two-phase condition can be confirmed through the first sight glass 88, and the cooling medium under the liquid phase condition can be confirmed through the second sight glass.

According to the construction described above, when the amount of the cooling medium becomes small and the heating degree SH exists on the outlet side of the evaporator 24 as in the cycle F, the degree of supercooling SC becomes small because the cooling capacity of the cooling medium in the condenser 22 is constant. Since the amount of supercooling is proportional to the pressure difference ΔP, the pressure difference ΔP′ between the pressure of the cooling medium on the inlet side of the capillary tube 84 and the pressure under the condition B′ on the saturation liquid line D also becomes small. At this time, after the pressure reduction by the first capillary tube 84, the cooling medium is in the gas-liquid two-phase condition as represented by G′, and this condition can be confirmed by the first site glass 88.

When excess cooling medium is charged, the cooling medium stays inside the accumulator 87 as in the cycle E and the cooling medium in the gas-liquid two-phase condition flows into the compressor 21, so the degree of supercooling becomes great. When the degree of supercooling SC becomes great, the pressure difference ΔP″ between the pressure of the cooling medium on the inlet side of the capillary tube 84 and the pressure under the condition B″ on the saturation liquid line D also becomes great. At this time, after the pressure reduction by the second capillary tube 85, the cooling medium is in the liquid phase condition as in the condition H″, and this condition can be confirmed through the second sight glass 89.

According to this construction, it is possible to judge whether or not the amount of the cooling medium is within a suitable range.

According to this construction, further, the cooling medium charge amount can be checked through the sight glasses 88, 89 disposed at the intermediate portions between the capillary tubes 84 to 86. Therefore, when the present detector is used for the air conditioner for a car, the charge amount can easily be checked inside the hood of the car.

In the embodiment of the accumulator circulation system 83 shown in FIG. 23, the sight glasses 88, 89 are disposed between the capillary tubes 84 to 86, but this arrangement is not particularly limitative. For example, small valves 901,902, 903, 904 are disposed in the piping on the upstream side of the capillary tube 84, between the capillary tubes 84 and 85, between the capillary tubes 85 and 86 and on the downstream side of the capillary tube 86, and the cooling medium charge amount detector 91 is disposed between any two small valves.

Figure 24A:
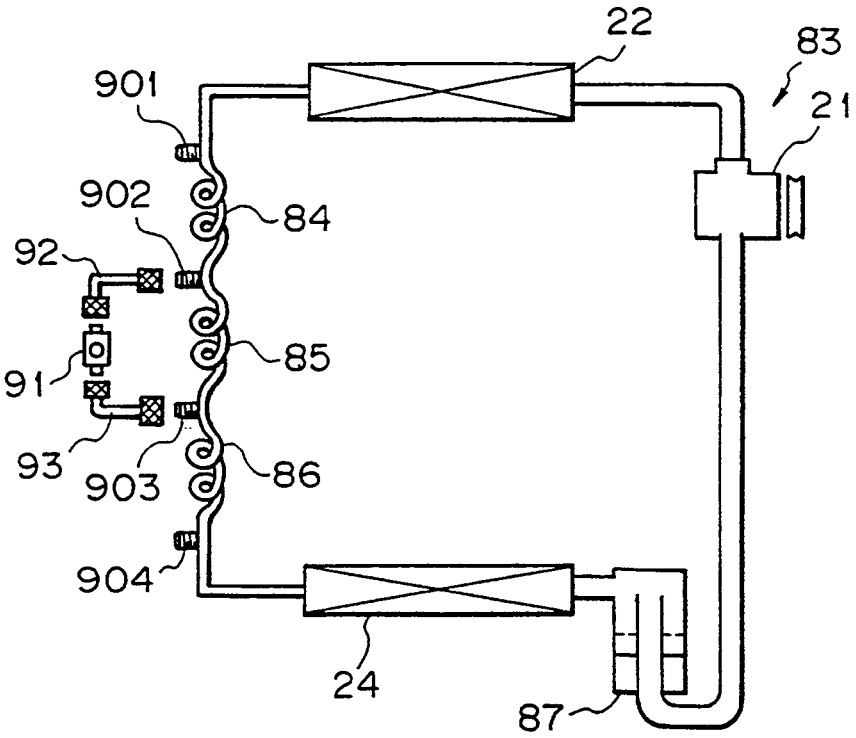
FIG. 24(*a*) is a schematic view showing another embodiment using the detector for the accumulator cycle.
Figure 24B:
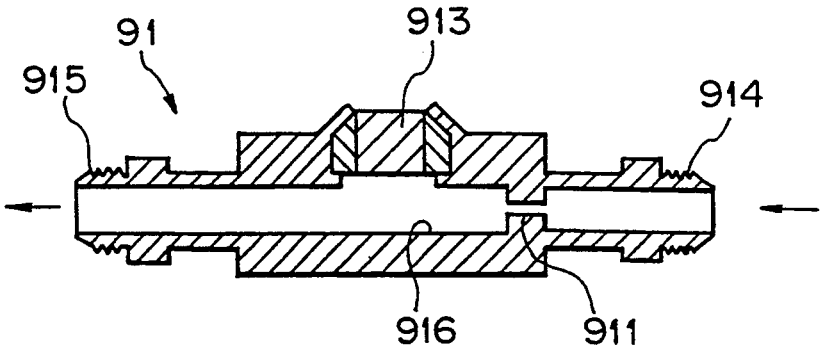

As shown in detail in FIG. 24(*b*), this cooling medium charge amount detector 91 includes the fixed throttle 911 disposed on the upstream side and the sight glass 913 for detecting the phase condition inside the flow passage 916 into which the cooling medium flows after the pressure reduction. The screw portions 914, 915 having a male screw threaded therein are disposed at both ends of this cooling medium charge amount detector 91. The screw portions 914, 915 of this cooling medium charge amount detector 91 are connected to the piping by the flexible hoses 92, 93.

When the cooling medium charge amount detector 91 is connected in parallel between the small valve 902 and the small valve 903 as shown in FIG. 24(*a*), for example, the throttle 911 is disposed only on the upstream side of the cooling medium seal amount detector 91. Accordingly, the pressure is reduced by the pressure difference component between the upstream side and the downstream side of the capillary tube 85 by this throttle 911. The phase condition of the cooling medium after this pressure condition can be detected through the sight glass 913 in the same way as the detection of the phase condition through the sight glass 89 as shown in FIG. 23.

In this embodiment, the pressure is reduced on the upstream side by the throttle 911 and the phase condition of the cooling medium is detected. However, it is also possible to employ a construction wherein the position of the cooling medium charge amount detector 91 exists on the downstream side, the flow of the cooling medium is throttled on the downstream side and the phase condition of the cooling medium on the upstream side is detected.

The cooling medium seal amount of the present invention can be applied to the refrigeration circulation system of vehicles.

The cooling medium charge amount detector may be not only of the removable type as shown in FIG. 2, but also of a fixed type which is always kept connected to the refrigeration circulation system. Even in the case of the removable type, the detector may be kept always connected to the refrigeration circulation system. If the detector is always connected to the refrigeration circulation system, the driver of a car can check the amount of the cooling medium, whenever necessary, and can supplement the cooling medium, if necessary.

As described above, the method and apparatus for detecting the cooling medium charge amount reduces the pressure of the cooling medium flowing out from the condenser over a plurality of stages through at least a desired intermediate pressure, and can detect whether or not the amount of the cooling medium is suitable by detecting the phase condition of the cooling medium after this pressure detection.

Accordingly, the present invention can provide a method and apparatus for detecting the charge amount of the cooling medium which can detect where the actual amount of the cooling medium is suitable for obtaining a desired degree of supercooling on the inlet side of the expansion valve inside the refrigeration circulation system without using sensors and computation means which have been necessary according to the prior art.

We claim:

1. In a refrigeration circulation system which includes a compressor for compressing a gaseous cooling medium, a condenser for cooling said gaseous cooling medium compressed by said compressor and converting it to a liquid cooling medium, first pressure reduction means for reducing the pressure of said cooling medium converted to said liquid cooling medium by said condenser and converting it to an atomized cooling medium, and an evaporator for subjecting said cooling medium atomized by said first pressure reduction means to heat-exchange with air, and in which said cooling medium on the inlet side of said first pressure reduction means has a certain degree of supercooling, a cooling medium charge amount detection method for detecting whether or not an actual amount of a cooling medium is a desired amount in comparison with an amount of said cooling medium necessary for having a desired degree of supercooling, said method comprising:

disposing second pressure reduction means in parallel with said first pressure reduction means, for reducing the pressure of said cooling medium flowing from said condenser to an evaporation pressure at said evaporator over a plurality of stages through at least a desired intermediate pressure; and detecting whether said cooling medium immediately after the pressure reduction to said desired intermediate pressure is in a two-phase gas-liquid condition or a liquid phase condition so as to detect whether or not the amount of said cooling medium is a desired amount.

2. In a refrigeration circulation system which includes a compressor for compressing a gaseous cooling medium, a condenser for cooling said gaseous cooling medium compressed by said compressor and converting it to a liquid cooling medium, pressure reduction means for reducing the pressure of said cooling medium converted to said liquid cooling medium by said condenser and converting it to an atomized cooling medium, and an evaporator for subjecting said cooling medium atomized by said first pressure reduction means to heat-exchange with air, and in which said cooling medium on the inlet side of said pressure reduction means has a certain degree of supercooling, a cooling medium charge amount detection method for detecting whether or not an actual amount of a cooling medium is a desired amount in comparison with an amount of said cooling medium necessary for having a desired degree of supercooling, said method comprising:

reducing a pressure by said pressure reduction means to an evaporation pressure of said evaporator over a plurality of stages through at least a desired intermediate pressure; and detecting whether or not the amount of said cooling medium is a desired amount by detecting in which of a two-phase gas-liquid condition and a liquid phase condition said cooling medium is immediately after the pressure reduction to said desired intermediate pressure.

3. A cooling medium seal amount detection method according to claim 1 or 2, wherein, when said desired intermediate pressure is a pressure lower than a pressure on a saturation liquid line when a desired amount of said cooling medium is charged into said refrigeration circulation system, said desired amount is judged as being charged when said cooling medium is in the gas-liquid two-phase condition at said intermediate pressure, and is judged as being excessively charged when said cooling medium is in the liquid phase condition at said intermediate pressure.

4. A cooling medium seal amount detection method according to claim 1 or 2, wherein, when said desired intermediate pressure is a pressure higher than a pressure on a saturation liquid line when a desired amount of said cooling medium is charged into said refrigeration circulation system, said desired amount is judged as being charged when said cooling medium is in the liquid phase condition, and is judged as being insufficient when said cooling medium is in the gas-liquid two-phase condition at said intermediate pressure.

5. In a refrigeration circulation system which includes a compressor for compressing a gaseous cooling medium, a condenser for cooling said gaseous cooling medium compressed by said compressor and converting it to a liquid cooling medium, first pressure reduction means for reducing the pressure of said cooling medium converted to said liquid cooling medium by said condenser and converting it to an atomized cooling medium, and an evaporator for subjecting said cooling medium atomized by said first pressure reduction means to heat-exchange with air, and in which said cooling medium on the inlet side of said first pressure reduction means has a certain degree of supercooling, a cooling medium charge amount detector for detecting whether or not an actual amount of a cooling medium is a desired amount in comparison with an amount of said cooling medium necessary for having a desired degree of supercooling, said detector comprising:

second pressure reduction means disposed in parallel with said first pressure reduction means, for reducing the pressure of said cooling medium flowing from said condenser to an evaporation pressure at said evaporator over a plurality of stages through at least a desired intermediate pressure; and detection means for detecting whether said cooling medium immediately after the pressure reduction to said desired intermediate pressure is in a gas-liquid two-phase condition or in a liquid phase condition so as to detect whether or not the amount of said cooling medium is a desired amount.

6. In a refrigeration circulation system which includes a compressor for compressing a gaseous cooling medium, a condenser for cooling said gaseous cooling medium compressed by said compressor and converting it to a liquid cooling medium, pressure reduction means for reducing the pressure of said cooling medium converted to said liquid cooling medium by said condenser and converting it to an atomized cooling medium, and an evaporator for subjecting said cooling medium atomized by said first pressure reduction means to heat-exchange with air, and in which said cooling medium on the outlet side of said pressure reduction means has a certain degree of supercooling, a cooling medium charge amount detector for detecting whether or not an actual amount of a cooling medium is a desired amount in comparison with an amount of said cooling medium necessary for having a desired degree of supercooling, said detector comprising:

pressure reduction means disposed between said condenser and said evaporator, for reducing the pressure of said liquid cooling medium flowing from said condenser to an evaporation pressure of said evaporator over a plurality of stages through at least a desired intermediate pressure; and detection means for detecting whether said cooling medium immediately after the pressure reduction to said desired intermediate pressure by said pressure reduction means is in a gas-liquid two-phase condition or in a liquid phase condition so as to detect whether or not the amount of said cooling medium is a desired amount.

7. A cooling medium charge amount detector according to claim 5 to 6, wherein, when said desired intermediate pressure is lower than a pressure on a saturation liquid line when the desired amount of said cooling medium is charged into said refrigeration circulation system, said detection means detects whether a phase condition is a gas-liquid two-phase condition representing that the desired amount of said cooling medium is charged, or a liquid phase condition representing that said cooling medium is excessively charged.

8. A cooling medium charge amount detector according to claim 5 or 6, wherein, when said desired intermediate pressure is a pressure higher than a pressure on a saturation liquid line when the desired amount of said cooling medium is charged into said refrigeration circulation system, said detection means detects whether a phase condition is a liquid phase condition representing that the desired amount of said cooling medium is charged, or a gas-liquid two-phase condition representing that said cooling medium is insufficient.

9. In a refrigeration circulation system which includes a compressor for compressing a gaseous cooling medium, a condenser for cooling said gaseous cooling medium compressed by said compressor and converting it to a liquid cooling medium, and an evaporator for subjecting said cooling medium flowing out from said condenser and atomized to heat-exchange with air, and in which said cooling medium on the outlet side of said condenser has a certain degree of supercooling, a cooling medium charge amount detector for detecting whether or not an actual amount of a cooling medium is a desired amount in comparison with an amount of said cooling medium necessary for having a desired degree of supercooling, said detector comprising:

second pressure reduction means disposed in parallel with first pressure reduction means, for reducing the pressure of said cooling medium flowing from said condenser to a pressure higher than a pressure on a saturation liquid line when a desired amount of said cooling medium is charged into said refrigeration circulation system;

third pressure reduction means for reducing the pressure of said cooling medium subjected to the pressure reduction by said second pressure reduction means to a pressure lower than a pressure on said saturation liquid line when the desired amount of said cooling medium is charged into said refrigeration circulation system;

fourth pressure reduction means for reducing the pressure of said cooling medium subjected to the pressure reduction by said third pressure reduction means to an evaporation pressure of said evaporator;

first detection means for detecting whether said cooling medium immediately after the pressure reduction by said second pressure reduction means is in a two-phase gas-liquid condition or a liquid phase condition; and second detection means for detecting whether said cooling medium immediately after the pressure reduction by said third pressure detection means is in two-phase the gas-liquid condition or the liquid phase condition.

10. A cooling medium charge amount detection method according to claim 3, wherein said second pressure reduction means and said detection means are removably disposed.

11. A cooling medium charge amount detector according to claim 5 to 6, which further comprises desired pressure variable means for varying said desired pressure in accordance with a load condition.

12. A cooling medium charge amount detector according to claim 5 or 6, wherein said detection means is a sight glass capable of observing the condition of said cooling medium.

* * * * *